US008851662B2

(12) United States Patent
Houjou

(10) Patent No.: US 8,851,662 B2
(45) Date of Patent: Oct. 7, 2014

(54) RECORDING MEDIUM CONVEYANCE DEVICE AND IMAGE FORMING APPARATUS

(75) Inventor: Hiroaki Houjou, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 92 days.

(21) Appl. No.: 13/557,219

(22) Filed: Jul. 25, 2012

(65) Prior Publication Data

US 2013/0050376 A1 Feb. 28, 2013

(30) Foreign Application Priority Data

Aug. 29, 2011 (JP) ..... 2011-186283

(51) Int. Cl.

| | |
|---|---|
| ***B41J 2/01*** | (2006.01) |
| ***B41J 29/38*** | (2006.01) |
| ***B41J 11/00*** | (2006.01) |

(52) U.S. Cl.

CPC ..... *B41J 11/002* (2013.01); *B41J 11/0085* (2013.01)

USPC ..... 347/104; 347/101; 347/16

(58) Field of Classification Search

CPC ..... B41J 11/007; B41J 11/06; B41J 2/2114; B41J 11/0015; B41J 11/002; B41J 11/42; B41J 29/393; B41J 13/08; B41J 11/0085; B41J 13/226; B41J 13/22; B41J 13/223

USPC ..... 347/16, 104, 102, 101; 101/488; 219/216; 346/25

See application file for complete search history.

(56) References Cited

U.S. PATENT DOCUMENTS

| | | | | |
|---|---|---|---|---|
| 5,199,623 | A * | 4/1993 | Rajala et al. | 242/615.12 |
| 5,230,165 | A * | 7/1993 | Beisswanger | 34/60 |
| 5,323,178 | A | 6/1994 | Mohnkern et al. | |
| 5,398,925 | A | 3/1995 | Zeltner | |
| 6,357,140 | B1 * | 3/2002 | Heyer et al. | 34/236 |
| 2009/0231407 | A1 * | 9/2009 | Kachi | 347/104 |

(Continued)

FOREIGN PATENT DOCUMENTS

| | | |
|---|---|---|
| JP | H05-294031 | 11/1993 |
| JP | H06-72586 | 3/1994 |

(Continued)

OTHER PUBLICATIONS

Partial English language translation of the following: Office action dated Aug. 20, 2013 from the Japanese Patent Office in a Japanese patent application corresponding to the instant patent application. The office action translation is submitted now in order to supplement the understanding of patent document JP2009-285777, JP2010-137406, JP2011-032036, JP2007-076175, JP2002-211788, JPH05-294031, JP2001-293844, JPH06-72586, JPH06-293128 and JP2007-038429 which are cited in the office action and are being considered.

*Primary Examiner* — Laura Martin

*Assistant Examiner* — Leonard S Liang

(74) *Attorney, Agent, or Firm* — SOLARIS Intellectual Property Group, PLLC

(57) ABSTRACT

A recording medium conveyance device comprising a conveying unit that conveys a recording medium while sucking the recording medium onto a conveyance surface, and an air blowing unit that is disposed at an upstream side of the conveying unit in a conveyance direction of the recording medium. The air blowing unit is configured to blow air in diagonal directions from a width direction center portion toward side portions at an upstream side of the recording medium, and adjusts a direction in which the air is blown in such a way that a width of an air blowing region of the air becomes narrower than a width of the recording medium conveyed to the conveying unit before the air strikes the recording medium.

21 Claims, 21 Drawing Sheets

(56) References Cited

U.S. PATENT DOCUMENTS

| | | | | |
|---|---|---|---|---|
| 2009/0295894 | A1 | 12/2009 | Hori | |
| 2010/0141725 | A1* | 6/2010 | Shiohara | 347/102 |
| 2010/0269366 | A1* | 10/2010 | Kitamoto et al. | 34/274 |

FOREIGN PATENT DOCUMENTS

| | | |
|---|---|---|
| JP | H06-293128 | 10/1994 |
| JP | 2001-293844 | 10/2001 |
| JP | 2002-211788 | 7/2002 |
| JP | 2007-038429 | 2/2007 |
| JP | 2007-076175 | 3/2007 |
| JP | 2009-285877 | 12/2009 |
| JP | 2010-137406 | 6/2010 |
| JP | 2010-159127 A | 7/2010 |
| JP | 2011-032036 | 2/2011 |

* cited by examiner

RECORDING MEDIUM CONVEYANCE DEVICE AND IMAGE FORMING APPARATUS

CROSS-REFERENCE TO RELATED APPLICATIONS

This application is based on and claims priority under 35 USC 119 from Japanese Patent Application No. 2011-186283 filed Aug. 29, 2011.

BACKGROUND OF THE INVENTION

1. Technical Field

The present invention relates to a recording medium conveyance device and an image forming apparatus.

2. Related Art

Conventionally, as image forming apparatus equipped with a recording medium conveyance device, there have been known liquid jet recording type image forming apparatus that have a liquid droplet jetting head in which numerous nozzles are arrayed, convey a recording medium (hereinafter called paper sheets) with respect to the liquid droplet jetting head, and jet liquid droplets of ink or the like from the nozzles toward the paper sheet to thereby form an image (including characters) on the paper sheet.

In the process after image formation, the image forming apparatus reduces paper sheet deformation strain (curling and cockling) occurring due to moisture in the liquid droplets by conveying, while sucking, the paper sheet onto which the ink droplets have been jetted. The image forming apparatus effectively reduces paper sheet deformation strain by implementing drying at the same time while sucking and conveying the paper sheet.

However, when the image forming apparatus tries to suck a paper sheet in a state in which paper sheet deformation strain is already progressing after image formation, wrinkles tend to be formed on the sheet at the time of suction compared to a case where the image forming apparatus sucks and conveys a paper sheet with no paper sheet deformation strain. Consequently, improvements in technology that can suck and convey, with no wrinkles, even a paper sheet in a state in which paper sheet deformation strain has progressed to a certain extent after image formation are needed.

Likewise, when the image forming apparatus tries to form an image on and suck a paper sheet in a state in which paper sheet deformation strain is already progressing before image formation, wrinkles are apt to be formed at the time of suction compared to a case where the image forming apparatus forms an image on and sucks and conveys a paper sheet in which there is no paper sheet deformation strain. Consequently, improvements in technology that can suck and convey, with no wrinkles, even a paper sheet in which paper sheet deformation strain has progressed to a certain extent before image formation are also needed.

To that end, in Japanese Patent Application Laid-Open (JP-A) No. 2010-159127, a technology that removes wrinkles formed in a paper sheet with warm air from a warm air jetting nozzle after image formation and before suction conveyance is disclosed. It is also disclosed that the warm air jetting nozzle is configured in such a way that an angle formed between a direction of the warm air and a paper sheet conveyance direction is increased from the width direction center portion toward the side end portions of the paper sheet.

SUMMARY

However, when the warm air blowing nozzle is configured in such a way that the angle formed between the direction of the warm air and the paper sheet conveyance direction is increased from the width direction center portion toward the side end portions of the paper sheet like in JP-A No. 2010-159127, there are cases where, depending on the angle between the direction of the warm air and the paper sheet conveyance direction and location of the warm air blowing nozzle, the warm air travels around to a back surface of the paper sheet and creates lift so that the paper may flap at the time of conveyance.

The present invention has been made in view of the above circumstances, and it is a subject to provide a recording medium conveyance device and an image forming apparatus that can both suppress wrinkling of a recording medium at the time of suction conveyance and suppress flapping of the recording medium at the time of air blowing.

A recording medium conveyance device pertaining to a first aspect of the present invention includes: a conveying unit that conveys a recording medium while sucking the recording medium onto a conveyance surface; and an air blowing unit that is disposed at an upstream side of the conveying unit in a conveyance direction of the recording medium, blows air in diagonal directions from a width direction center portion of the recording medium toward side portions at an upstream side of the recording medium, and adjusts the direction in which the air is blown in such a way that a width of an air blowing region of the air becomes narrower than a width of the recording medium conveyed to the conveying unit before the air strikes the recording medium.

According to the configuration of the first aspect, the air blowing unit is disposed at the upstream side of the conveying unit in the conveyance direction of the recording medium, so the air blowing unit blows air in diagonal directions from the center portion of the recording medium toward the side portions at the upstream side of the recording medium. Because of this, a force that causes the recording medium to expand in diagonal directions from the center portion toward the side rear ends of the recording medium in accompaniment with the progression of the conveyance can be applied before the recording medium is restrained by suction by the conveyance unit, and the paper sheet deformation strain occurring in the center portion can be dispersed (smoothed out) in the directions to the side rear ends of the recording medium or removed. Consequently, the paper sheet deformation strain in the recording medium can be dispersed or eliminated when the recording medium is conveyed to the conveying unit and the suction is started, and wrinkling of the recording medium at the time of suction conveyance can be suppressed.

Further, the air blowing unit that suppresses this wrinkling adjusts the direction in which the air is blown in such a way that the width of the air blowing region of the air becomes narrower than the width of the recording medium conveyed to the conveying unit before the air strikes the recording medium. For this reason, a situation where the air goes directly outside the recording medium and ends up traveling around to the back surface of the recording medium can be prevented. Because of this, lifting of the recording medium can be suppressed and flapping of the recording medium at the time of the air blowing can be suppressed.

As described above, according to the first aspect of the present invention, both wrinkling of the recording medium at the time of the suction conveyance and flapping of the recording medium at the time of the air blowing can be suppressed.

In a recording medium conveyance device pertaining to a second aspect of the present invention, in the first aspect, the conveying unit is equipped with a gripping part that grips and conveys a leading end of the recording medium and a suction body that sucks, onto the conveyance surface, the recording medium conveyed by the gripping means.

According to the configuration of the second aspect, the leading end of the recording medium is gripped and conveyed by the gripping unit while the recording medium is sucked onto the conveyance surface by the suction body, so compared to a case where the entire recording medium is sucked onto (brought into close contact with) the conveyance surface and is conveyed integrally with the conveyance surface, the force with which the recording medium is restrained is weaker and wrinkling of the recording medium at the time of the suction conveyance can be suppressed.

In a recording medium conveyance device pertaining to a third aspect of the present invention, in the first aspect or the second aspect, the air blowing unit increases an air volume in a center portion in the width of the air blowing region.

According to this configuration, the paper sheet deformation strain tends to concentrate in the center portion of the recording medium, so by increasing the air volume in the center portion in the width of the air blowing region, even more of the paper sheet deformation strain can be dispersed toward the side rear ends of the recording medium or removed.

In the recording medium conveyance device pertaining to the fourth aspect of the present invention, in any one aspect of the first aspect to the third aspect, the air blowing unit adjusts the direction in which the air is blown or adjusts the air volume of the air in accordance with rigidity of the recording medium.

According to this configuration, by making an adjustment in such a way as to narrow the width of the air blowing region with respect to the width of the recording medium (e.g., thin paper) that tends to flap, compared to the case of thick paper, flapping of the recording medium at the time of the air blowing can be suppressed even more. Further, by making an adjustment in such a way as to increase the air volume for a recording medium whose rigidity is low and the paper sheet deformation amount is large, compared to the case of thick paper, the paper sheet deformation strain in the recording medium can be dispersed even more toward the side rear end portions of the paper sheet or removed.

In a recording medium conveyance device pertaining to a fifth aspect of the present invention, in any one of the first aspect to the fourth aspect, the air blowing unit adjusts the direction in which the air is blown in such a way that the width of the air blowing region becomes equal to 50% to 95% of the width of the recording medium conveyed to the conveying means.

In this way, if the width of the air blowing region is equal to or greater than 50% of the width of the recording medium conveyed to the conveying means, the effect of pressing the side rear end portions of the recording medium can be raised. Further, if the width of the air blowing region is equal to or less than 95% of the width of the recording medium conveyed to the conveying unit, flapping of the recording medium can suppressed even more.

In a recording medium conveyance device pertaining to a sixth aspect of the present invention, in the first aspect, the conveying unit is equipped with an impression cylinder that rotates in a state in which the impression cylinder closely holds the recording medium by sucking the recording medium onto the conveyance surface and conveys the recording medium.

According to this configuration, the recording medium is rotated and conveyed in a state in which it is sucked and closely held on the impression cylinder, so the posture of the recording medium that is being conveyed can be held.

In a recording medium conveyance device pertaining to a seventh aspect of the present invention, in any one of the first aspect to the sixth aspect, openings for suction are disposed in the conveyance surface, and an area of the openings is increased in a stepwise manner from an upstream side toward a downstream side in the conveyance direction of the recording medium.

According to this configuration, a suction volume of the recording medium increases in a stepwise manner in accompaniment with the conveyance on the conveyance surface, and abrupt changes in the suction volume of the recording medium can be suppressed at the time of the suction conveyance. Because of this, wrinkling of the recording medium at the time of the suction conveyance can be suppressed.

In a recording medium conveyance device pertaining to an eighth aspect of the present invention, in the seventh aspect, the area of the openings is increased in a stepwise manner from a center portion toward side end portions of the conveyance surface.

According to this configuration, the area of the openings of the openings is increased in a stepwise manner from the upstream side toward the downstream side in the conveyance direction and is increased in a stepwise manner from the center portion toward the side end portions of the conveyance surface, so a force that causes the recording medium to expand in diagonal directions from the center portion to the side rear end portions of the recording medium can be applied in accompaniment with the progression of the conveyance of the recording medium on the conveyance surface, and the paper sheet deformation strain that tends to occur in the center portion of the recording medium can be dispersed in the directions toward the side rear ends of the recording medium or removed.

In a recording medium conveyance device pertaining to a ninth aspect of the present invention, in the sixth aspect, a suction region of the conveyance surface of the impression cylinder is segmented from a place that sucks a leading end portion of the recording medium toward a place that sucks a trailing end portion of the recording medium.

According to this configuration, the suction can be started in a stepwise manner from the leading end portion of the recording medium.

In a recording medium conveyance device pertaining to a tenth aspect of the present invention, in the seventh aspect or the eighth aspect, the openings are configured as V-shaped openings, top portions of V shaped-openings are formed at downstream sides in the conveyance direction of the recording medium.

According to this configuration, a force that causes the recording medium to expand in diagonal directions from the center portion to the side rear end portions of the recording medium in accompaniment with the progression of the conveyance on the conveyance surface can be applied, and the paper sheet deformation strain that tends to occur in the center portion of the recording medium can be disposed toward the side rear end portions or removed.

In a recording medium conveyance device pertaining to an eleventh aspect of the present invention, in any one of the first aspect to the sixth aspect, openings for suction are disposed in the conveyance surface, and the openings are configured as inverted V-shaped openings, bottom portions of V shaped-openings are formed at downstream sides in the conveyance direction of the recording medium.

According to this configuration, the side end portions of the recording medium are sucked before the center portion, so in a case where the air is blown by the air blowing unit during the suction conveyance, flapping of the recording medium at the time of the suction conveyance caused by the air traveling around from a rear surface of the recording medium can be effectively deterred.

In a recording medium conveyance device pertaining to a twelfth aspect of the present invention, in any one of the first aspect to the eleventh aspect, the air blowing unit is equipped with plural air blowers placed along the width direction of the recording medium that is conveyed.

According to this configuration, the direction in which the air is blown and the air volume can be changed individually, so more detailed adjustment of the width of the air blowing region and adjustment of the air volume can be realized.

In a recording medium conveyance device pertaining to a thirteenth aspect of the present invention, in the twelfth aspect, the air blowing unit adjusts the directions in which the air is blown by the air blowers in such a way that inclination of the air blowers with respect to a centerline of the recording medium becomes smaller gradually from the center portion toward the side portions of the recording medium.

According to this configuration, the paper sheet deformation strain that has occurred in the center portion of the recording medium can be exerted with air blow for a longer time and the paper sheet deformation strain can be dispersed toward the side rear ends of the recording medium or removed, and the air blown by the blowers at the side end portions of the recording medium can be prevented from going outside the recording medium.

In a recording medium conveyance device pertaining to a fourteenth aspect of the present invention, in the twelfth aspect, the air blowing unit adjusts the directions in which the air is blown by the air blowers in such a way that inclination of the air blowers with respect to a centerline of the recording medium becomes larger gradually from the center portion toward the side portions of the recording medium.

According to this configuration, the paper sheet deformation strain that has occurred in the center portion of the recording medium can be gradually dispersed toward the side rear ends of the recording medium or removed.

In a recording medium conveyance device pertaining to a fifteenth aspect of the present invention, in any one of the first aspect to the fourteenth aspect, the air blowing unit is equipped with plural air blowers placed along the conveyance direction of the recording medium.

According to this configuration, wrinkling of the recording medium at the time of the suction conveyance can be suppressed even more.

In a recording medium conveyance device pertaining to a sixteenth aspect of the present invention, in the fifteenth aspect, the air blowing unit adjusts the direction in which the air is blown in such a way that a width of an air blowing region of the air blower disposed at the downstream side in the conveyance direction becomes wider than a width of an air blowing region of the air blower disposed at the upstream side in the conveyance direction.

According to this configuration, the width of the air blowing region of the air blower (overall) disposed on the upstream side in the conveyance direction is narrower than the width of the air blowing region of the air blower (overall) disposed on the downstream side, so at the time of the conveyance the air is blown first with respect to the center portion of the recording medium. As a result, the paper sheet deformation strain in the center portion of the recording medium is dispersed to the side ends and the air is blown in a wider air blowing region width in accompaniment with the progression of the conveyance, the paper sheet deformation strain that has been dispersed to the side ends can be further dispersed and made uniform in the width direction of the recording medium, and wrinkling of the recording medium at the time of the suction conveyance can be suppressed even more.

In a recording medium conveyance device pertaining to a seventeenth aspect of the present invention, in any one of the first aspect to the sixteenth aspect, the air blowing unit is equipped with a heater that turns the air into hot air.

According to this configuration, the recording medium onto which liquid droplets, for example, have been jetted can be dried by the hot air of the air blowing unit, and therefore the paper sheet deformation strain can be reduced.

In a recording medium conveyance device pertaining to an eighteenth aspect of the present invention, in any one of the first aspect to the seventeenth aspect, the recording medium conveyance device further includes drying unit that dries the recording medium conveyed by the conveying means.

According to this configuration, drying can be promoted by the drying unit in a state in which the paper sheet deformation strain is suppressed, and the paper sheet deformation strain amount after paper discharge can be reduced even more.

In a recording medium conveyance device pertaining to a nineteenth aspect of the present invention, in the eighteenth aspect, the drying unit applies heat to the conveyance surface to thereby dry the recording medium.

According to this configuration, the recording medium can be dried from a back surface of the recording medium onto which liquid droplet, for example, have been jetted, so it is difficult for the liquid droplets to bleed even when drying is performed.

An image recording apparatus pertaining to a twentieth aspect of the present invention includes the recording medium conveyance device according to any one of the first aspect to the nineteenth aspect; and a liquid droplet jetting head that jets liquid droplets onto the recording medium to draw an image, wherein the air blowing unit is disposed between the liquid droplet jetting head and the conveying unit.

According to this configuration, after the drawing by the liquid droplet jetting head, the paper sheet deformation strain in the recording medium can be dispersed from the center portion toward the side rear end portions of the recording medium or removed by the air blowing unit. Additionally, the recording medium is sucked and conveyed by the conveying unit without an interval, so the paper sheet deformation strain can be suppressed from occurring again before the recording medium is conveyed by the conveying unit.

In an image forming apparatus pertaining to a twenty-first aspect of the present invention, in the twentieth aspect, the air blowing unit increases an air volume with respect to a drawn section of the recording medium where the liquid droplets have been jetted than an air volume of the air with respect to a non-drawn section.

According to this configuration, the air blowing means increases the air volume with respect to the drawn section that tends to rise because of the liquid droplets than the air volume with respect to the non-drawn section, so rising of the drawn section can be suppressed.

According to the present invention, there can be provided a recording medium conveyance device and an image recording apparatus that suppress both wrinkling of the recording medium at the time of the suction conveyance and flapping of the recording medium at the time of the air blowing.

DESCRIPTION

First Embodiment

Figure 1:
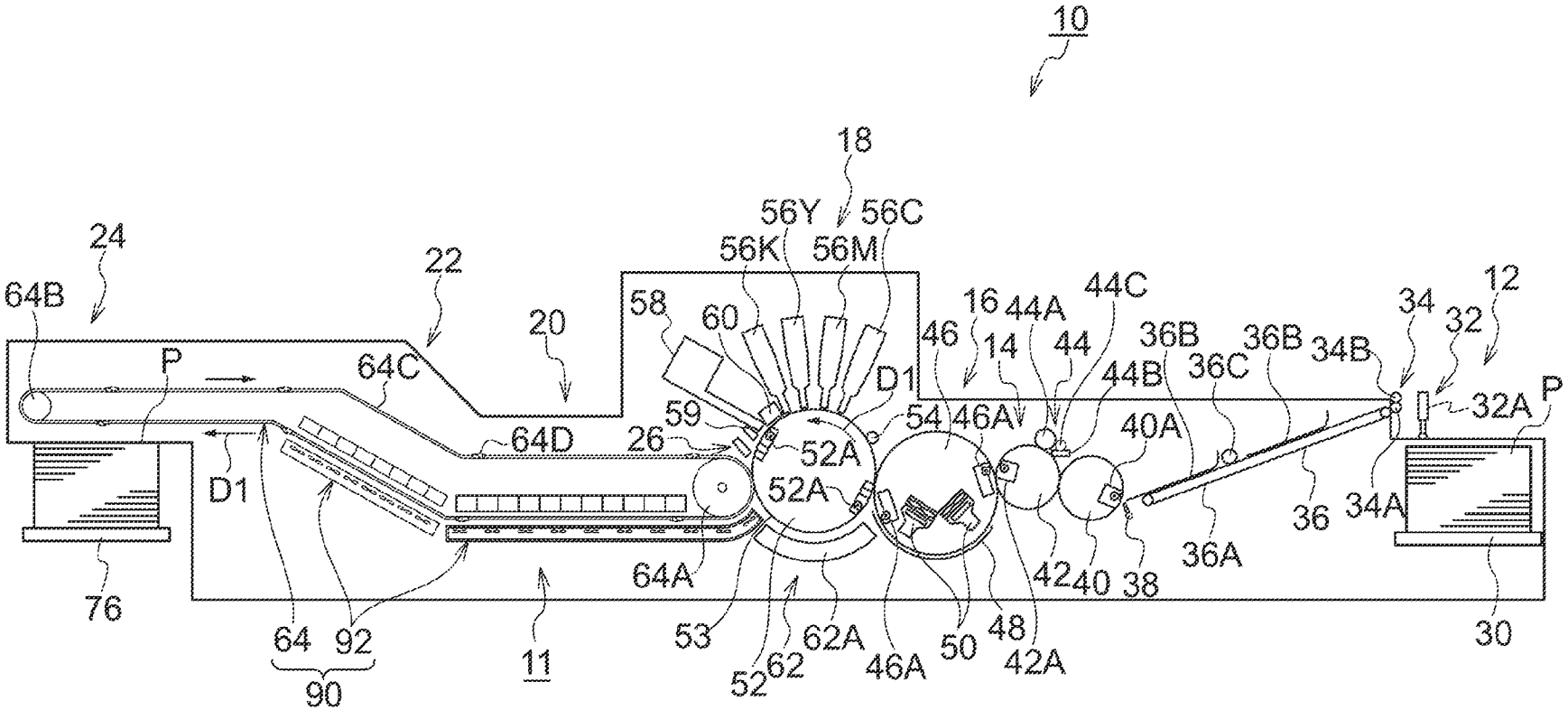
FIG. 1 is a diagram showing the overall configuration of an image forming apparatus pertaining to a first embodiment of the present invention.

A recording medium conveyance device and an image forming apparatus pertaining to a first exemplary embodiment of the present invention will be described specifically below with reference to the attached drawings. The same reference signs will be given to members (configural elements) having identical or corresponding functions in the drawings, and description will be omitted as appropriate.

Configuration of Image Forming Apparatus

FIG. 1 is a diagram showing an overall configuration of an image forming apparatus pertaining to a first exemplary embodiment of the present invention.

The image forming apparatus is an inkjet recording apparatus 10 that is equipped with a recording medium conveyance device 11, uses water-based UV ink (UV (ultraviolet)-curable ink using a water-based medium) to record an image by the inkjet format on paper sheets (a recording medium) P, and thereafter conveys the paper sheets P to the recording medium conveyance device 11.

The inkjet recording apparatus 10 is mainly configured by: a paper feed section 12 that feeds the paper sheets P; a process liquid application section 14 that applies a predetermined process liquid to front surfaces (image recording surfaces) of the paper sheets P that have been fed from the paper feed section 12; a process liquid drying treatment section 16 that administers a drying treatment to the paper sheets P to which the process liquid has been applied by the process liquid application section 14; an image recording section 18 that uses water-based UV ink to record an image by the inkjet format on the front surfaces of the paper sheets P to which the drying treatment has been administered by the process liquid drying treatment section 16 and conveys the paper sheets P to the recording medium conveyance device 11; and a paper discharge section 24 that discharges the paper sheets P that have been conveyed by the recording medium conveyance device 11.

The recording medium conveyance device 11 is mainly configured by: an ink drying treatment section 20 that administers a drying treatment to the paper sheets P on which the images have been recorded by the image recording section 18; and a UV irradiation treatment section 22 that administers a UV irradiation treatment (a fixing treatment) to the paper sheets P to which the drying treatment has been administered by the ink drying treatment section 20 to thereby fix the images. In this first embodiment, the recording medium conveyance device 11 is also configured to include an air blowing section 26 that is disposed between the image recording section 18 and the ink drying treatment section 20 and blows air with respect to the paper sheets P.

Paper Feed Section

The paper feed section 12 feeds the paper sheets P, which are stacked in a paper feed tray 30, one sheet at a time to the process liquid application section 14. The paper feed section 12 is mainly configured by the paper feed tray 30, a sucker device 32, a paper feed roller pair 34, a feeder board 36, a feed guide 38, and a paper feed drum 40.

The paper sheets P are placed in the paper feed tray 30 as a stack in which numerous sheets are stacked on top of each other. The paper feed tray 30 is disposed in such a way that it can be raised and lowered by an unillustrated paper feed tray raising-and-lowering device. The driving of the paper feed tray raising-and-lowering device is controlled in conjunction with increases and decreases in the number of the paper sheets P stacked in the paper feed tray 30. The paper feed tray raising-and-lowering device raises and lowers the paper feed tray 30 in such a way that the paper sheet P positioned in the uppermost position of the stack is always positioned at a fixed height.

The paper sheets P serving as the recording medium are not particularly limited, but general-purpose printing paper (paper mainly consisting of cellulose, such as so-called wood-free paper, coated paper, and art paper) used in common offset printing and so forth can be used. In this example, coated paper is used. Coated paper is commonly formed by applying a coating material to the front surface of wood-free paper or acid-free paper that has not been surface-treated to thereby dispose a coat layer on the paper. Specifically, art paper, coated paper, lightweight coated paper, and lightly coated paper can be suitably used.

The sucker device 32 picks up, one sheet at a time sequentially from above, the paper sheets P stacked in the paper feed tray 30 and feeds the paper sheets P to the paper feed roller pair 34. The sucker device 32 is equipped with a suction foot 32A that is disposed in such a way that it may be freely raised and lowered and freely swung. The sucker device 32 sucks and holds the upper surface of the paper sheet P with the suction foot 32A and transfers the paper sheet P from the paper feed tray 30 to the paper feed roller pair 34. At this time, the suction foot 32A sucks and holds the upper surface on the leading end side of the paper sheet P, pulls up the paper sheet P, and inserts the leading end of the paper sheet P between a pair of rollers 34A and 34B configuring the paper feed roller pair 34.

The paper feed roller pair 34 is configured by an upper and lower pair of rollers 34A and 34B that are pressed against and brought into contact with each other. One of the upper and lower pair of rollers 34A and 34B is a drive roller (the roller 34A) and the other is a driven roller (the roller 34B). The drive roller (the roller 34A) is driven to rotate by an unillustrated motor. The motor is driven in conjunction with the feeding of the paper sheet P, and when the paper sheet P is fed from the sucker device 32, the motor causes the drive roller (the roller 34A) to rotate in accordance with the timing of the feeding. The paper sheet P that has been inserted between the upper and lower pair of rollers 34A and 34B is nipped in the paper feed roller pair 34 and is fed in the installation direction of the feeder board 36.

The feeder board 36 is formed in correspondence to the width of the paper sheets P, receives the paper sheet P that has been fed from the paper feed roller pair 34, and guides the paper sheet P to the feed guide 38. The feeder board 36 is installed in such a way as to be inclined downward, allows the paper sheet P that has been placed on top of its conveyance surface to slide along the conveyance surface, and guides the paper sheet P to the feed guide 38.

Tape feeders 36A for conveying the paper sheet P are plurally installed on the feeder board 36 at intervals apart from each other in the width direction. The tape feeders 36A are formed in endless shapes and are driven to rotate by an unillustrated motor. The paper sheet P that has been placed on the conveyance surface of the feeder board 36 is fed by the tape feeders 36A and is conveyed on the feeder board 36.

Retainers 36B and a roller 36C are also installed on the feeder board 36.

The retainers 36 are plurally placed at upstream and downstream in a longitudinal direction along a conveyance surface for the paper sheet P (in this example, there are two retainers 36B). The retainers 36B are configured by plate springs that have a width corresponding to the width of the paper sheets P. The retainers 36B are installed in such a way that they are pressed against and brought into contact with the conveyance surface. The paper sheet P conveyed on the feeder board 36 by the tape feeders 36A passes through the retainers 36B, whereby unevenness are corrected. The retainers 36B are formed in such a way that their rear end portions are curled in order to make it easier to introduce the paper sheet P between the retainers 36B and the feeder board 36.

The roller 36C is disposed between the upstream and downstream retainers 36B. The roller 36C is installed in such a way that it is pressed against and brought into contact with the conveyance surface of the paper sheet P. The paper sheet P conveyed between the upstream and downstream retainers 36B is conveyed while its upper surface is held down by the roller 36C.

The feed guide 38 corrects the posture of the paper sheet P. The feed guide 38 is formed in a plate shape and is placed orthogonal to the conveyance direction of the paper sheet P. The feed guide 38 is driven by an unillustrated motor and is swingably disposed. The leading end of the paper sheet P that has been conveyed on the feeder board 36 is brought into contact with the feed guide 38, whereby the posture of the paper sheet P is corrected (so-called skew prevention). The feed guide 38 swings in conjunction with the feeding of the paper sheet P to the paper feed drum 40 and transfers the paper sheet P whose posture has been corrected to the paper feed drum 40.

The paper feed drum 40 receives the paper sheet P fed from the feeder board 36 via the feed guide 38 and conveys the paper sheet P to the process liquid application section 14. The paper feed drum 40 is formed in a cylindrical shape and is driven to rotate by an unillustrated motor. A gripper 40A is disposed on the outer peripheral surface of the paper feed drum 40, and the leading end of the paper sheet P is gripped by the gripper 40A. The paper feed drum 40 grips the leading end of the paper sheet P with the gripper 40A and rotates, whereby the paper feed drum 40 wraps the paper sheet P onto its peripheral surface and conveys the paper sheet P to the process liquid application section 14.

Process Liquid Application Section

The process liquid application section 14 applies a predetermined process liquid to the front surface (image recording surface) of the paper sheet P. The process liquid application section 14 is mainly configured by a process liquid application drum 42 that conveys the paper sheet P and a process liquid application unit 44 that applies the process liquid to a printing surface of the paper sheet P conveyed by the process liquid application drum 42.

The process liquid application drum 42 receives the paper sheet P from the paper feed drum 40 and conveys the paper sheet P to the process liquid drying treatment section 16. The process liquid application drum 42 is formed in a cylindrical shape and is driven to rotate by an unillustrated motor. A gripper 42A is disposed on the outer peripheral surface of the process liquid application drum 42, and the leading end of the paper sheet P is gripped by the gripper 42A. The process liquid application drum 42 grips the leading end of the paper sheet P with the gripper 42A and rotates, whereby the process liquid application drum 42 wraps the paper sheet P onto its peripheral surface and conveys the paper sheet P to the process liquid drying treatment section 16 (the process liquid application drum 42 conveys one paper sheet P by one rotation). The rotation of the process liquid application drum 42 and the rotation of the paper feed drum 40 are controlled in such a way that the timing of the receipt of the paper sheet P by the process liquid application drum 42 and the timing of the transfer of the paper sheet P by the paper feed drum 40 coincide. That is, the process liquid application drum 42 and the paper feed drum 40 are driven in such a way that they have the same circumferential speed and the positions of their grippers coincide.

The process liquid application unit 44 applies the process liquid by means of a roller to the front surface of the paper sheet P conveyed by the process liquid application drum 42. The process liquid application unit 44 is mainly configured by an application roller 44A that applies the process liquid to the paper sheet P, a process liquid tank 44B in which the process liquid is stored, and a draw roller 44C that draws up the process liquid stored in the process liquid tank 44B and supplies the process liquid to the application roller 44A. The draw roller 44C is installed such that it presses against and contacts the application roller 44A and part of the draw roller 44C is immersed in the process liquid stored in the process liquid tank 44B. The draw roller 44C measures and draws up the process liquid and applies the process liquid in a fixed thickness to the peripheral surface of the application roller 44A. The application roller 44A is disposed in correspondence to the width of the paper sheets P, is pressed against and brought into contact with the paper sheet P, and applies to the paper sheet P the process liquid that has been applied to the peripheral surface of the application roller 44A. The application roller 44A is driven by an unillustrated reciprocating mechanism and moves between a contact position in which the application roller 44A contacts the peripheral surface of the process liquid application drum 42 and a retracted position in which the application roller 44A is retracted from the peripheral surface of the process liquid application drum 42. The reciprocating mechanism moves the application roller 44A in accordance with the timing of the passage of the paper sheet P to apply the process liquid to the front surface of the paper sheet P conveyed by the process liquid application drum 42.

The process liquid applied to the front surface of the paper sheet P has the function of aggregating the color materials in the water-based UV ink which is jetted onto the paper sheet P by an image recording section 18 provided at following process. By applying the process liquid to the front surface of the paper sheet P and jetting the water-based UV ink, high-definition printing can be performed with avoiding landing interference of the ink or the like even in the case of using general-purpose printing paper.

Process Liquid Drying Treatment Section

The process liquid drying treatment section 16 administers a drying treatment to the paper sheet P to whose front surface the process liquid has been applied. The process liquid drying treatment section 16 is mainly configured by a process liquid drying treatment drum 46 that conveys the paper sheet P, a paper sheet conveyance guide 48, and a process liquid drying treatment unit 50 that blows hot air onto the printing surface of the paper sheet P conveyed by the process liquid drying treatment drum 46 to thereby dry the printing surface of the paper sheet P.

The process liquid drying treatment drum 46 receives the paper sheet P from the process liquid application drum 42 and conveys the paper sheet P to the image recording section 18. The process liquid drying treatment drum 46 is configured by a frame body assembled in a cylindrical shape and is driven to rotate by an unillustrated motor. A gripper 46A is disposed on the outer peripheral surface of the process liquid drying treatment drum 46, and the leading end of the paper sheet P is gripped by the gripper 46A. The process liquid drying treatment drum 46 grips the leading end of the paper sheet P with the gripper 46A and rotates, whereby the process liquid drying treatment drum 46 conveys the paper sheet P to the image recording section 18. The process liquid drying treatment drum 46 in this example is configured in such a way that the gripper 46A is disposed in two places on the outer peripheral surface of the drum 46 so that two paper sheets P can be conveyed by one rotation. The rotation of the process liquid drying treatment drum 46 and the rotation of the process liquid application drum 42 are controlled in such a way that the timing of the receipt of the paper sheet P by the process liquid drying treatment drum 46 and the timing of the transfer of the paper sheet P by the process liquid application drum 42 coincide. That is, the process liquid drying treatment drum 46 and the process liquid application drum 42 are driven such that they have the same circumferential speed and the positions of their grippers coincide.

The paper sheet conveyance guide 48 is disposed along a conveyance path of the paper sheet P formed along the process liquid drying treatment drum 46 and guides the conveyance of the paper sheet P.

The process liquid drying treatment unit 50 is installed at an inner side of the process liquid drying treatment drum 46 and blows hot air toward the front surface of the paper sheet P conveyed by the process liquid drying treatment drum 46 to thereby dry the front surface of the paper sheet P. In this example, two of the process liquid drying treatment units 50 are disposed inside the process liquid drying treatment drum 46 and are given a configuration where they blow hot air toward the front surface of the paper sheet P conveyed by the process liquid drying treatment drum 46.

Image Recording Section

The image recording section 18 jets liquid droplets of ink (water-based UV ink) of the colors of cyan (C), magenta (M), yellow (Y), and black (K) onto the printing surface of the paper sheet P to thereby draw a color image on the printing surface of the paper sheet P. The image recording section 18 is mainly configured by an image recording drum 52 that conveys the paper sheet P, a paper sheet holding roller 54 that presses the paper sheet P to bring the paper sheet P into close contact with an outer peripheral surface 53 of the image recording drum 52, inkjet heads 56C, 56M, 56Y, and 56K that jet ink droplets of the colors of C, M, Y, and K onto the paper sheet P, an inline sensor 58 that reads the image that has been recorded on the paper sheet P, a mist filter 60 that corrects ink mist, and a drum cooling unit 62.

The image recording drum 52 receives the paper sheet P from the process liquid drying treatment drum 46 and conveys the paper sheet P to the ink drying treatment section 20. The image recording drum 52 is formed in a cylindrical shape and is driven to rotate by an unillustrated motor. A gripper 52A is disposed on the outer peripheral surface 53 of the image recording drum 52, and the leading end of the paper sheet P is gripped by the gripper 52A. The image recording drum 52 grips the leading end of the paper sheet P with the gripper 52A and rotates, whereby the image recording drum 52 wraps the paper sheet P onto the peripheral surface 53 and conveys the paper sheet P to the ink drying treatment section 20. Numerous suction holes (not illustrated) are formed in a predetermined pattern in the outer peripheral surface 53 of the image recording drum 52. The paper sheet P that has been wrapped onto the outer peripheral surface 53 of the image recording drum 52 is sucked from the section holes, whereby the paper sheet P is conveyed while being sucked and held on the outer peripheral surface 53 of the image recording drum 52. Because of this, the paper sheet P can be conveyed with a high degree of smoothness.

The suction from the suction holes acts only in a fixed range and acts between a predetermined start-of-suction position and a predetermined end-of-suction position. The start-of-suction position is set in the installation position of the paper sheet holding roller 54, and the end-of-suction position is set between the installation position of the inline sensor 58 and the air blowing section 26. That is, the start-of-suction position and the end-of-suction position are set in such a way that the paper sheet P is sucked and held on the outer peripheral surface 53 of the image recording drum 52 at least in the installation position of the inkjet heads 56C, 56M, 56Y, and 56K (which is an image recording position) and the installation position of the inline sensor 58 (which is an image reading position). Additionally, the suction are stopped and the paper sheet P is in a free state (an unrestrained state), excluding the leading end of the paper sheet P gripped (restraint) by the gripper 52A, before the air blown by the air blowing section 26 strikes the paper sheet P.

The image recording drum 52 of the present embodiment is configured in such a way that the gripper 52A is disposed in two places on the outer peripheral surface 53 so that two paper sheets P can be conveyed by one rotation. The rotation of the image recording drum 52 and the rotation of the process liquid drying treatment drum 46 are controlled in such a way that the timing of the receipt of the paper sheet P by the image recording drum 52 and the timing of the transfer of the paper sheet P by the process liquid drying treatment drum 46 coincide. That is, the image recording drum 52 and the process liquid drying treatment drum 46 are driven in such a way that they have the same circumferential speed and the positions of their grippers coincide.

The paper sheet holding roller 54 is disposed in the neighborhood of a paper sheet receiving position of the image recording drum 52 (the position at which the image recording drum 52 receives the paper sheet P from the process liquid drying treatment drum 46). The paper sheet holding roller 54 is configured by a rubber roller and is installed such that it is pressed against and brought into contact with the outer peripheral surface 53 of the image recording drum 52. The paper sheet P that has been transferred from the process liquid drying treatment drum 46 to the image recording drum 52 is nipped and brought into close contact with the outer peripheral surface 53 of the image recording drum 52 as a result of passing through the paper sheet holding roller 54.

The four inkjet heads 56C, 56M, 56Y, and 56K are placed at predetermined intervals apart from each other along the conveyance path of the paper sheet P formed along the image recording drum 52. The inkjet heads 56C, 56M, 56Y, and 56K are configured by line heads corresponding to the width of the paper sheets P and are placed in such a way that their nozzle surfaces oppose the outer peripheral surface 53 of the image recording drum 52. The inkjet heads 56C, 56M, 56Y, and 56K jet liquid droplets of ink from nozzle rows formed in their nozzle surfaces toward the image recording drum 52 to thereby record an image on the paper sheet P conveyed by the image recording drum 52.

As described above, water-based UV ink is used for the ink jetted from the inkjet heads 56C, 56M, 56Y, and 56K. Water-based UV ink can be cured by irradiating it with ultraviolet (UV) light after it has been jetted.

The inline sensor 58 is installed on the downstream side of the last inkjet head 56K with respect to a conveyance direction D1 of the paper sheet P along the image recording drum 52 and reads the image that has been recorded by the inkjet heads 56C, 56M, 56Y, and 56K. The inline sensor 58 is configured by a line scanner, for example, and reads the image on the paper sheet P conveyed by the image recording drum 52.

A contact prevention plate 59 is installed on the downstream side of the inline sensor 58 in proximity to the line sensor 58. The contact prevention plate 59 prevents the paper sheet P from contacting the inline sensor 58 in a case where the paper sheet P has risen due to conveyance trouble or the like.

The mist filter 60 is disposed between the last inkjet head 56K and the inline sensor 58 and sucks the air around the image recording drum 52 to correct ink mist. In this way, the ingress of ink mist into the inline sensor 58 can be prevented and the occurrence of reading defects and so forth can be prevented.

The drum cooling unit 62 blows cold air onto the image recording drum 52 to thereby cool the image recording drum 52. The drum cooling unit 62 is mainly configured by an air conditioner (not illustrated) and a duct 62A that blows cold air supplied from the air conditioner onto the outer peripheral surface 53 of the image recording drum 52. The duct 62A blows the cold air onto a region of the image recording drum 52 outside the region of the image recording drum 52 that conveys the paper sheet P to thereby cool the image recording drum 52. In this example, the paper sheet P is conveyed along a circular arc surface substantially on the upper half of the image recording drum 52, so the duct 62A is given a configuration that blows the cold air onto the region of substantially the lower half of the image recording drum 52 to thereby cool the image recording drum 52. Specifically, the duct 62A is given a configuration where the air outlet of the duct 62A is formed in a circular arc shape in such a way as to cover substantially the lower half of the image recording drum 52 and the cold air is blown onto the region of substantially the lower half of the image recording drum 52.

A temperature to which the drum cooling unit 62 cools the image recording drum 52 is determined in accordance with temperatures of the inkjet heads 56C, 56M, 56Y, and 56K (particularly the temperature of the nozzle surfaces), and the image recording drum 52 is cooled in such a way that its temperature becomes lower than the temperatures of the inkjet heads 56C, 56M, 56Y, and 56K. Because of this, dew condensation can be prevented from forming on the inkjet heads 56C, 56M, 56Y, and 56K. That is, by making the temperature of the image recording drum 52 lower than the temperature of the inkjet heads 56C, 56M, 56Y, and 56K, dew condensation can be induced on the image recording drum 52 side and dew condensation forming on the inkjet heads 56C, 56M, 56Y, and 56K (particularly dew condensation forming on their nozzle surfaces) can be prevented.

The paper sheet P is transferred to the recording medium conveyance device 11 after the image has been recorded on the paper sheet P and the paper sheet P has been released from the sucked state. After being transferred to the recording medium conveyance device 11, the paper sheet P is conveyed while being administered an air blowing treatment, a drying treatment, a UV treatment, and so forth as described later and is transferred to the paper discharge section 24.

Paper Discharge Section

The paper discharge section 24 collects the paper sheets P on which the series of image recording processes has been performed. The paper discharge section 24 is mainly configured by a chain gripper 64 that conveys the paper sheets P that have been irradiated with ultraviolet light by the UV irradiation treatment section 22 of the recording medium conveyance device 11 and a paper discharge tray 76 that stacks and collects the paper sheets P.

The chain gripper 64 is shared by the ink drying treatment section 20 and the UV irradiation treatment section 22. The chain gripper 64 releases the paper sheets P above the paper discharge tray 76 and stacks the paper sheets P in the paper discharge tray 76. The detailed configuration of the chain gripper 64 will be described later.

The paper discharge tray 76 stacks and collects the paper sheets P that have been released from the chain gripper 64. Paper guides (a front paper guide, a rear paper guide, lateral paper guides, etc.) are disposed on the paper discharge tray 76 so that the paper sheets P are stacked in an orderly manner (not illustrated).

The paper discharge tray 76 is disposed to be raised and lowered by an unillustrated paper discharge tray raising-and-lowering device. The driving of the paper discharge tray raising-and-lowering device is controlled in conjunction with increases and decreases in the number of the paper sheets P stacked in the paper discharge tray 76. The paper discharge tray raising-and-lowering device raises and lowers the paper discharge tray 76 in such a way that the paper sheet P positioned in the uppermost position is always positioned at a fixed height.

Configuration of Recording Medium Conveyance Device

Next, the configuration of the recording medium conveyance device 11, from when the paper sheet P is transferred from the image recording section 18 to the recording medium conveyance device 11 to until the paper sheet P is transferred from the recording medium conveyance device 11 to the paper discharge section 24, will be described.

Figure 2:
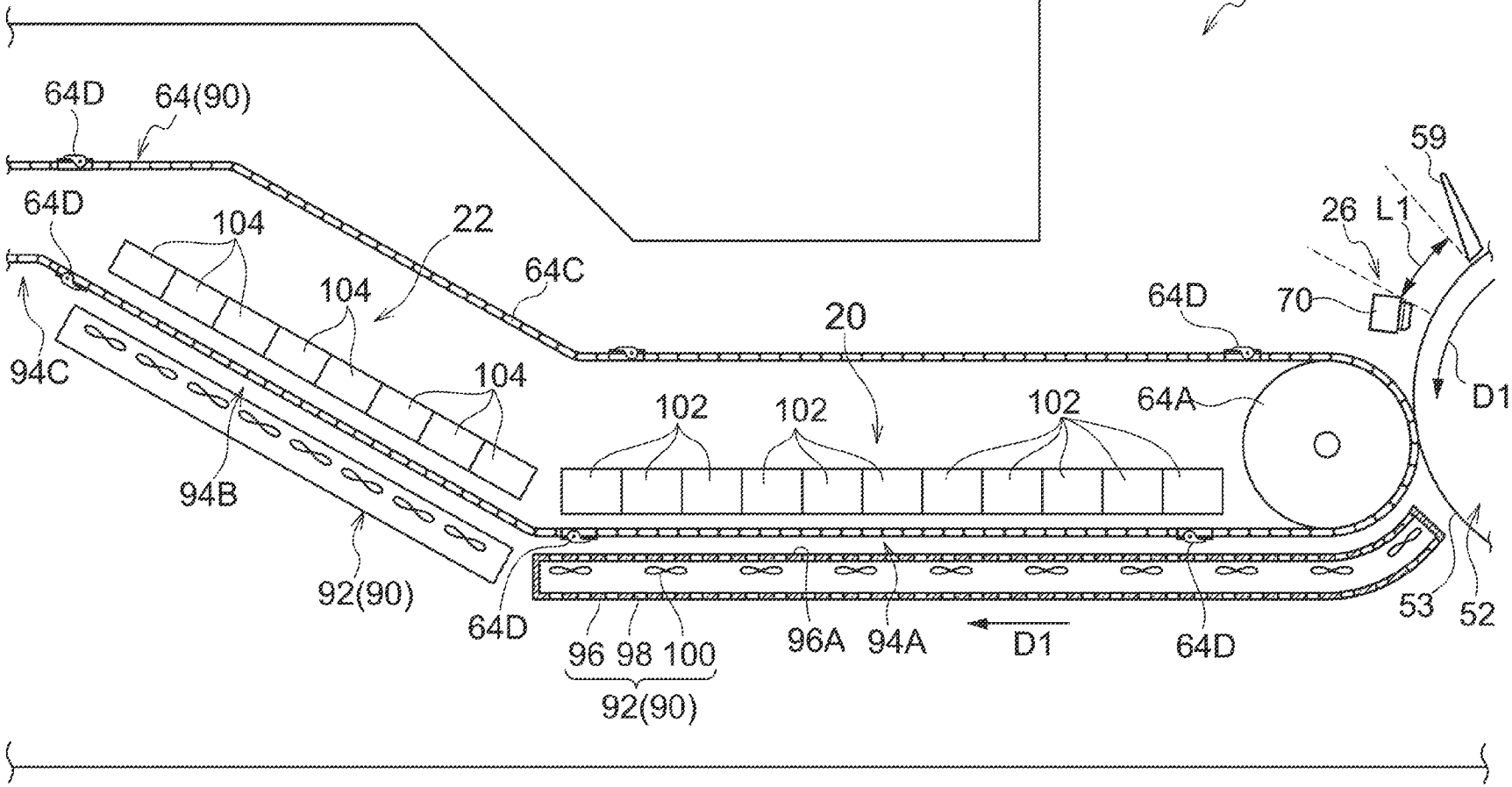
FIG. 2 is a diagram showing the overall configuration of a recording medium conveyance device pertaining to the first embodiment of the present invention.

FIG. 2 is a diagram showing the overall configuration of the recording medium conveyance device 11 pertaining to the first exemplary embodiment of the present invention.

The recording medium conveyance device 11 is, as described above, mainly configured by the air blowing section 26, the ink drying treatment section 20, and the UV irradiation treatment section 22.

Air Blowing Section

The air blowing section 26 is disposed on an upstream side of a later-described conveyance mechanism 90 of the recording medium conveyance device 11 in the conveyance direction D1. The air blowing section 26 is configured by an air blowing unit 70 and the above-described image recording drum 52. The air blowing unit 70 is disposed between the inkjet heads 56C, 56M, 56Y, and 56K and the chain gripper 64.

The air blowing unit 70 blows air in diagonal directions from a center portion toward side portions (side rear end portions) of the paper sheet P before the leading end of the paper sheet P is conveyed by the chain gripper 64 after having passed the contact prevention plate 59. Note that the side rear end portions of the paper sheet P is positioned at the upstream side in the conveyance direction of the paper sheet P conveyed by the image recording drum 52. The air blowing unit 70 thus presses the paper sheet P against the outer peripheral surface 53 of the image recording drum 52.

The air blowing unit 70 is in proximity to the contact prevention plate 59 to an extent that an air blown by the air blowing unit 70 does not directly strike the contact prevention plate 59. Specifically, a distance L1 along the conveyance direction D1 between an end portion of the air blowing unit 70 in the conveyance direction D1 upstream side and an end portion of the contact prevention plate 59 in the conveyance direction D1 downstream side is set shorter than an average length of the paper sheets P. The average length of the paper sheets P is obtained by averaging lengths in the conveyance direction D1 of all types of the paper sheets P conveyable by the recording medium conveyance device 11. Because of this, in a case where a length in the conveyance direction D1 of the paper sheet P is longer than the average length, even if the paper sheet P rises up at the time of the air blowing, part of the front surface of the paper sheet P contacts the contact prevention plate 59, so an amount of rising up of the paper sheet P is suppressed.

Figure 3A:
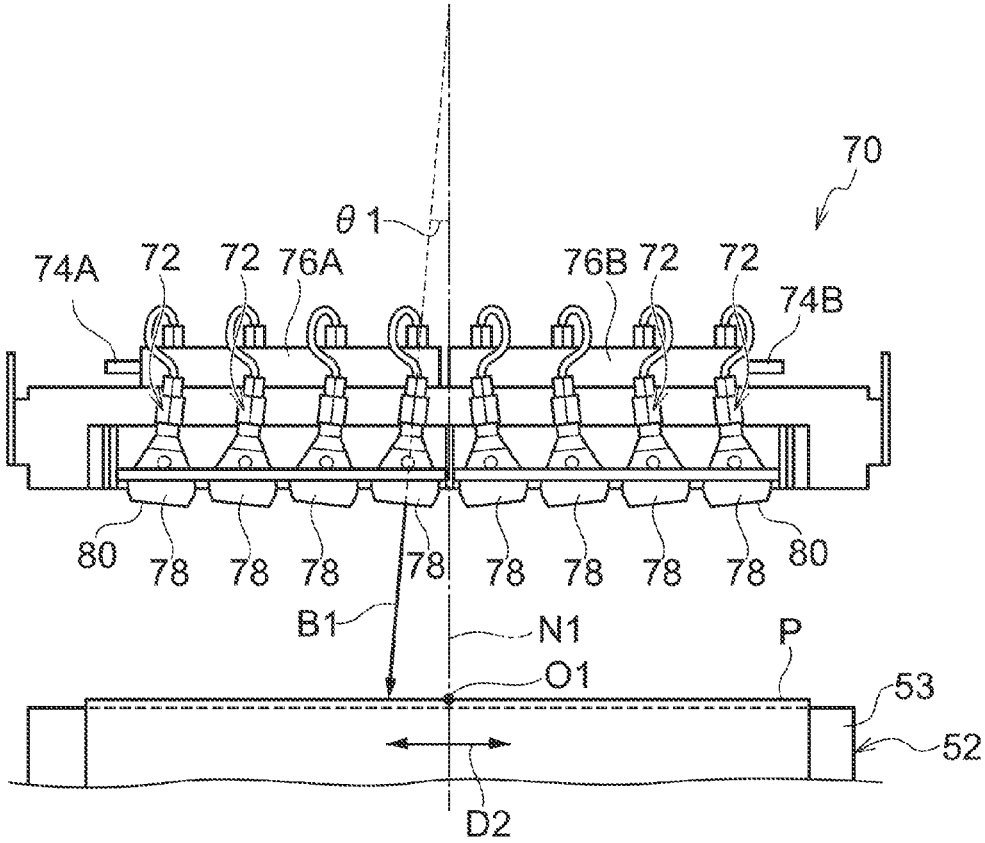
FIG. 3A is a partially exploded front view of an air blowing unit.

FIG. 3A is a partially exploded front view of the air blowing unit 70.

The air blowing unit 70 is equipped with plural air blowers 72 placed along the width direction of the paper sheet P (a width direction D2 of the outer peripheral surface 53 of the image recording drum 52) that is conveyed. In the first embodiment, a centerline N1 of the air blowing unit 70 is placed such that it passes through a center O1 of the outer peripheral surface 53 of the image recording drum 52. Four of the air blowers 72 each are disposed on both sides of the centerline N1 in the width direction D2 of the image recording drum 52.

The air blowers 72 are equipped with an unillustrated air generating source (e.g., a fan), which is shared by the air blowers 72, and two air inlets 74A and 74B and two air volume regulation units 76A and 76B, which are shared by each of the four air blowers 72 on both sides of the centerline N1. The air blowers 72 are equipped with individual nozzles 78.

The air inlet 74A allows the air blown from the air generating source to flow into the air volume regulation unit 76A. The air inlet 74B allows the air blown from the air generating source to flow into the air volume regulation unit 76B.

The air volume regulation unit 76A is communicated with the air inlet 74A and four of the nozzles 78. The air volume regulation unit 76B is communicated with the air inlet 74B and four of the nozzles 78. The air volume regulation units 76A and 76B are each equipped with unillustrated regulators per air blower 72, and the regulators can regulate per air blower 72 (nozzle 78) an volume of the air inflowing from the air inlets 74A and 74B. The air whose volume has been regulated by the air volume regulation units 76A and 76B flows into the nozzles 78 of the air blowers 72.

The nozzles 78 straightly blow out, from nozzle outlets 80, air B1 whose air volume has been regulated by the air volume regulation units 76A and 76B. Blades or the like that regulate a direction of the air are not disposed in the nozzle outlets 80. Instead, an angle of inclination θ1 by which each of the nozzles 78 faces the outer peripheral surface 53 of the image recording drum 52 is configured to be adjustable with respect to the centerline N1 (or the centerline of the paper sheet P). The θ1 is defined that an angle in the clockwise direction of FIG. 3A is positive. The direction in which the air B1 is blown out from the nozzles 78 can be adjusted by changing this angle. However, in the first embodiment, the four nozzles 78 communicated with the air volume regulation unit 76A are designed in such a way that they all have the same angle of inclination θ1 when the angle of inclination is adjusted. Likewise, the four nozzles 78 communicated with the air volume regulation unit 76B are also designed in such a way that they all have the same angle of inclination −θ1 when the angle of inclination is adjusted.

Figure 3B:
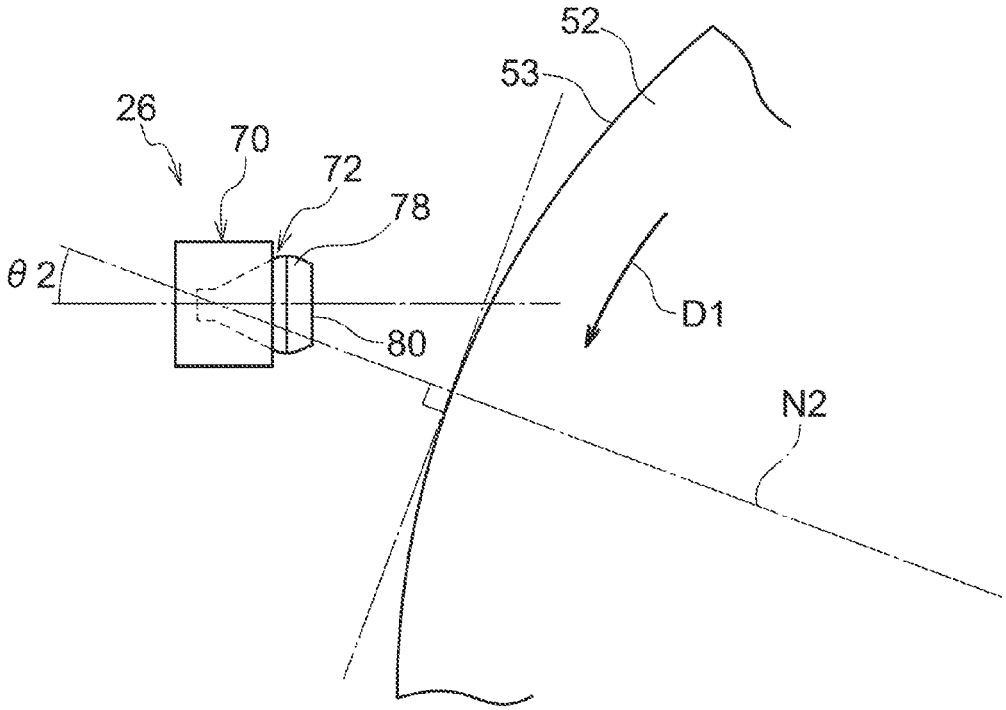
FIG. 3B is a side view of the air blowing unit.

FIG. 3B is a side view of the air blowing unit 70.

As shown in FIG. 3B, the nozzles 80 of the air blowers 72 are inclined by an angle θ2 to the upstream side in the conveyance direction D1 with respect to a normal line N2 of the outer peripheral surface 53 of the image recording drum 52. The angle of inclination θ2 is set in such a way that it is greater than 0° and less than 90° and preferably is set to be less than 60° from the standpoint that the paper sheet P is effectively pressed. In the first embodiment, the angle of inclination θ2 differs from the angle of inclination θ1 and is configured to be unadjustable and fixed.

Returning now to FIG. 2, after the air blowing by the air blowing unit 70 has ended, the paper sheet P is transferred by the chain gripper 64 from the air blowing section 26 to the ink drying treatment section 20.

Configuration of Conveying Part Including Chain Gripper

Next, the configuration of the conveyance mechanism 90 of the recording medium conveyance device 11 will be described.

The conveyance mechanism 90 of the recording medium conveyance device 11 pertaining to the first embodiment is mainly configured by the chain gripper 64 that conveys the paper sheet P on which the image has been recorded and a back tension application mechanism 92 that applies back tension to the paper sheet P conveyed by the chain gripper 64.

As described above, the chain gripper 64 is a paper sheet conveyance mechanism which is commonly used in the ink drying treatment section 20, the UV irradiation treatment section 22, and the paper discharge section 24. The chain gripper 64 receives the paper sheet P that has been transferred from the air blowing section 26 and conveys the paper sheet P to the paper discharge section 24.

The chain gripper 64 is mainly configured by a first sprocket 64A that is installed in proximity to the image recording drum 52, a second sprocket 64B (see FIG. 1) that is installed in the paper discharge section 24, an endless chain 64C that is wrapped around the first sprocket 64A and the second sprocket 64B, plural chain guides (not illustrated) that guide the travel of the chain 64C, and plural grippers 64D that are attached at regular intervals apart from each other to the chain 64C. The first sprocket 64A, the second sprocket 64B, the chain 64C, and the chain guides are each configured in pairs and are disposed on both sides with respect to the width direction of the paper sheet P. The grippers 64D are installed in such a way as to span the chains 64C disposed in a pair.

The first sprocket 64A is installed in proximity to the image recording drum 52 so that the paper sheet P transferred from the image recording drum 52 can be received by the grippers 64D. The first sprocket 64A is supported by unillustrated bearings, is disposed to be freely rotatable, and is coupled to an unillustrated motor. The chain 64C wrapped around the first sprocket 64A and the second sprocket 64B travels as a result of the motor being driven.

The second sprocket 64B is installed in the paper discharge section 24 so that the paper sheet P that has been received from the image recording drum 52 can be collected by the paper discharge section 24 (see FIG. 1). That is, the installation position of the second sprocket 64B is configured to be at the terminal end of the conveyance path of the chain gripper 64 for the paper sheet P. The second sprocket 64B is supported by unillustrated bearings and is disposed to be freely rotatable.

The chain 64C is formed in an endless shape and is wrapped around the first sprocket 64A and the second sprocket 64B.

The chain guides are placed in predetermined positions and guide the chain 64C such that the chain 64C travels a predetermined path (i.e., the chain guides guide the chain 64C so that the paper sheet P is conveyed on a predetermined conveyance path). In the inkjet recording apparatus 10 of the first embodiment, the second sprocket 64B is disposed in a higher position than the first sprocket 64A. For this reason, a traveling path in which the chain 64C becomes inclined on the way is formed. Specifically, the traveling path is configured by a first horizontal conveyance path 94A, an inclined conveyance path 94B, and a second horizontal conveyance path 94C.

The first horizontal conveyance path 94A is set to the same height as the first sprocket 64A such that the chain 64C wrapped around the first sprocket 64A travels horizontally.

The second horizontal conveyance path 94C is set to the same height as the second sprocket 64B such that the chain 64C wrapped around the second sprocket 64B travels horizontally.

The inclined conveyance path 94B is set between the first horizontal conveyance path 94A and the second horizontal conveyance path 94C and joins the first horizontal conveyance path 94A and the second horizontal conveyance path 94C.

The chain guides are disposed in such a way as to form the first horizontal conveyance path 94A, the inclined conveyance path 94B, and the second horizontal conveyance path 94C. Specifically, the chain guides are disposed at least in the points where the first horizontal conveyance path 94A and the inclined conveyance path 94B join to each other and in the points where the inclined conveyance path 94B and the second horizontal conveyance path 94C join to each other.

The grippers 64D are plurally attached at regular intervals apart from each other to the chain 64C. The intervals at which the grippers 64D are attached are set so as to correspond to the intervals at which the grippers 64D receive the paper sheets P from the image recording drum 52. That is, the intervals at which the grippers 64D are attached are set in correspondence to timing at which the grippers 64D receive the paper sheets P successively transferred from the image recording drum 5. The grippers 64D can match the transfer timing and receive the paper sheets P from the image recording drum 52.

The chain gripper 64 is configured as described above. When the motor (not illustrated) connected to the first sprocket 64A is driven, the chain 64C travels. The chain 64C travels at the same speed as the circumferential speed of the image recording drum 52. The timings are matched in such a way that the paper sheets P transferred from the image recording drum 52 can be received by the grippers 64D.

The back tension application mechanism 92 applies back tension to the paper sheet P conveyed with its leading end gripped by the chain gripper 64. The back tension application mechanism 92 is mainly configured by a guide plate 96 and suction fans 100 that suck in air from suction holes 98 formed in the guide plate 96.

The guide plate 96 is configured by a hollow box plate that has a width corresponding to the width of the paper sheets P. The guide plate 96 is disposed along the conveyance path of the paper sheet P provided by the chain gripper 64 (i.e., the traveling path of the chain 64C). Specifically, the guide plate 96 is disposed along the chain 64C that travels the first horizontal conveyance path 94A and the inclined conveyance path 94B, and the guide plate 96 is disposed a predetermined distance apart from the chain 64C.

Figure 4A:
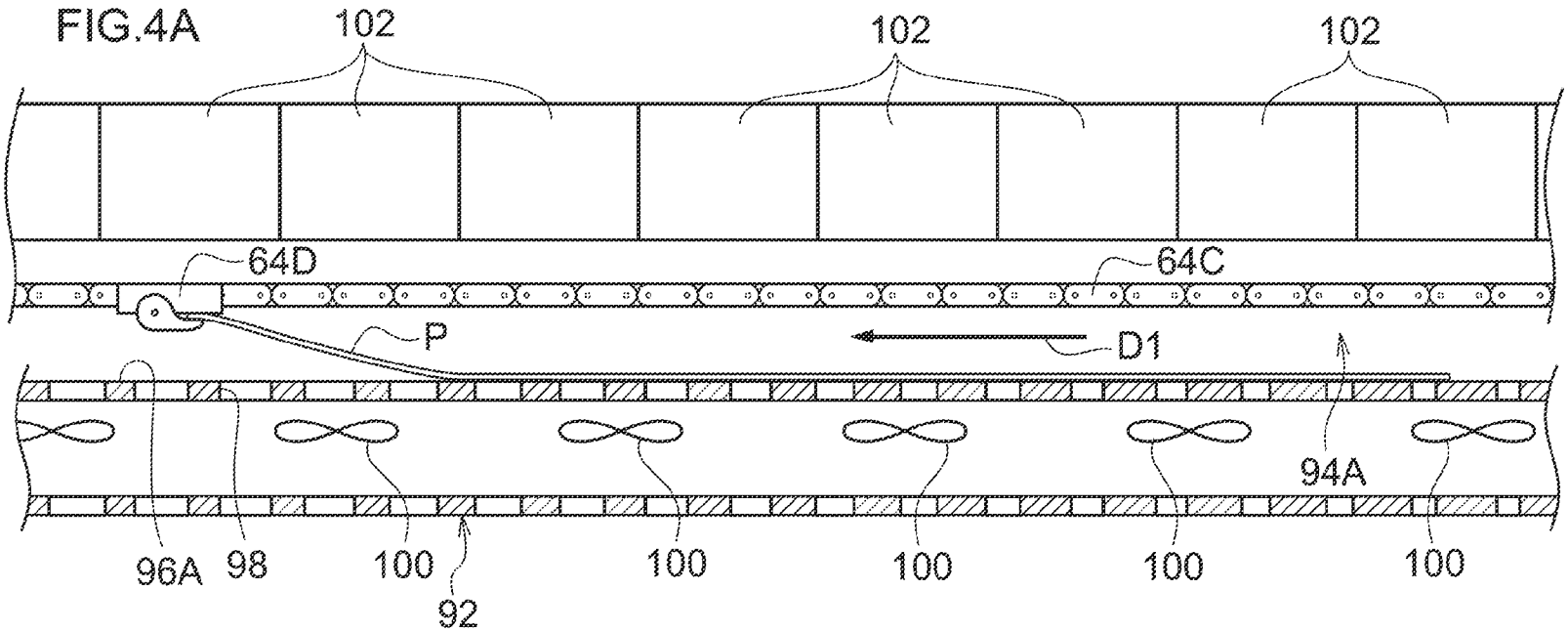
FIG. 4A is a side view of a guide plate.
Figure 4B:
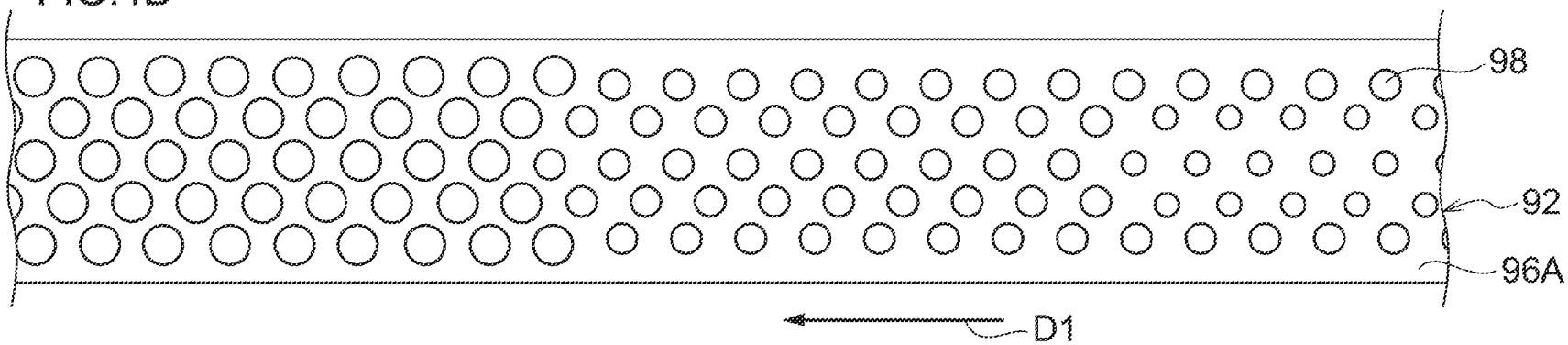
FIG. 4B is a plan view of the guide plate.

FIG. 4A is a side view of the guide plate 96. FIG. 4B is a plan view of the guide plate 96.

As shown in FIG. 4A, the paper sheet P held by the chain gripper 64 is conveyed with its back surface (the surface on the side on which the image is not recorded) sliding on and contacting an upper surface 96A (a sliding contact surface opposing the chain 64C) of the guide plate 96.

As shown in FIG. 4B, the suction holes 98 are formed numerously in a predetermined pattern in the sliding contact surface 96A of the guide plate 96. In the first embodiment, the predetermined pattern is set in such a way that an opened area formed by the suction holes 98 becomes larger in a stepwise manner from the upstream side toward the downstream side in the conveyance direction D1. Moreover, the predetermined pattern is set in such a way that the opened area of the suction holes 98 becomes larger in a stepwise manner from a center portion toward side end portions of the sliding contact surface 96A.

Examples for making the opened area of the suction holes 98 larger include increasing number of the holes and enlarging a hole area.

The suction fans 100 suck air into the hollow portion (the inside) of the guide plate 96. Because of this, air is sucked in through the suction holes 98 formed in the sliding contact surface 96A, the back surface of the paper sheet P conveyed by the chain gripper 64 is sucked at the suction holes 98, and back tension is applied to the paper sheet P (hereinafter, sometimes this action of the paper sheet P being sucked while the paper sheet P is conveyed will be called "suction conveyance"). The back tension is applied while the paper sheet P is being conveyed on the first horizontal conveyance path 94A and the inclined conveyance path 94B because the guide plate 96 is disposed along the chain 96C traveling the first horizontal conveyance path 94A and the inclined conveyance path 94B.

In the first embodiment, suction is set to start by the suction fans 100 and the suction holes 98 when the gripping of the paper sheet P has been started by the chain gripper 64.

Returning now to FIG. 2, the paper sheet P on which the image has been recorded is transferred by the chain gripper 64 from the air blowing section 26 to the ink drying treatment section 20.

Ink Drying Treatment Section

The ink drying treatment section 20 administers a drying treatment to the paper sheet P after image recording to remove liquid components remaining on the front surface of the paper sheet P. The ink drying treatment section 20 is configured by the above-described conveyance mechanism (the chain gripper 64 and the back tension application mechanism 92) and ink drying treatment units 102 that administer the drying treatment to the paper sheet P conveyed by the chain gripper 64.

The ink drying treatment units 102 are installed inside the chain gripper 64 (particularly in a site configuring the first horizontal conveyance path 94A) and administer the drying treatment with respect to the paper sheet P conveyed on the first horizontal conveyance path 94A. The ink drying treatment units 102 administer the drying treatment by blowing hot air onto the front surface of the paper sheet P conveyed on the first horizontal conveyance path 94A. The ink drying treatment units 102 are plurally placed along the first horizontal conveyance path 94A. The number of the ink drying treatment units 102 that are installed is set in accordance with the processing capability of the ink drying treatment units 102 and the conveyance speed (i.e., that is, the printing speed) of the paper sheet P. That is, the number of the ink drying treatment units 102 is set such that the paper sheet P received from the air blowing section 26 can be dried while it is being conveyed on the first horizontal conveyance path 94A. Consequently, the length of the first horizontal conveyance path 94A is also set in consideration of the capability of the ink drying treatment units 102.

A humidity in the ink drying treatment section 20 rises as a result of performing the drying treatment. When the humidity rises, the drying treatment becomes unable to be performed efficiently, so it is preferred that exhaust means be installed together with the ink drying treatment units 102 in the ink drying treatment section 20 and that the humid air generated by the drying treatment be forcibly exhausted. The exhaust means can be configured by installing an exhaust duct in the ink drying treatment section 20, for example, and the air in the ink drying treatment section 20 can be exhausted by the exhaust duct.

UV Irradiation Treatment Section

The UV irradiation treatment section 22 applies ultraviolet (UV) light to the image that has been recorded using water-based UV ink to thereby fix the image. The UV irradiation treatment section 22 is mainly configured by the above-described conveyance mechanism 90 (the chain gripper 64 and the back tension application mechanism 92) and UV irradiation units 104 that apply ultraviolet light to the paper sheet P to which the drying treatment has been administered and which is conveyed by the chain gripper 64.

The UV irradiation units 104 are installed inside the chain gripper 64 (particularly in the site configuring the inclined conveyance path 94B) and apply ultraviolet light to the front surface of the paper sheet P conveyed on the inclined conveyance path 94B. The UV irradiation units 104 are equipped with ultraviolet lamps (UV lamps) and are plurally disposed along the inclined conveyance path 94B. The number of the UV irradiation units 104 that are installed is set in accordance with the conveyance speed (i.e., the printing speed) of the paper sheet P. That is, the number of the UV irradiation units 104 is set such that the image can be fixed by the ultraviolet light that is applied while the paper sheet P is being conveyed on the inclined conveyance path 94B. Consequently, the length of the inclined conveyance path 94B is also set in consideration of the conveyance speed of the paper sheet P and so forth.

Control System

Figure 5:
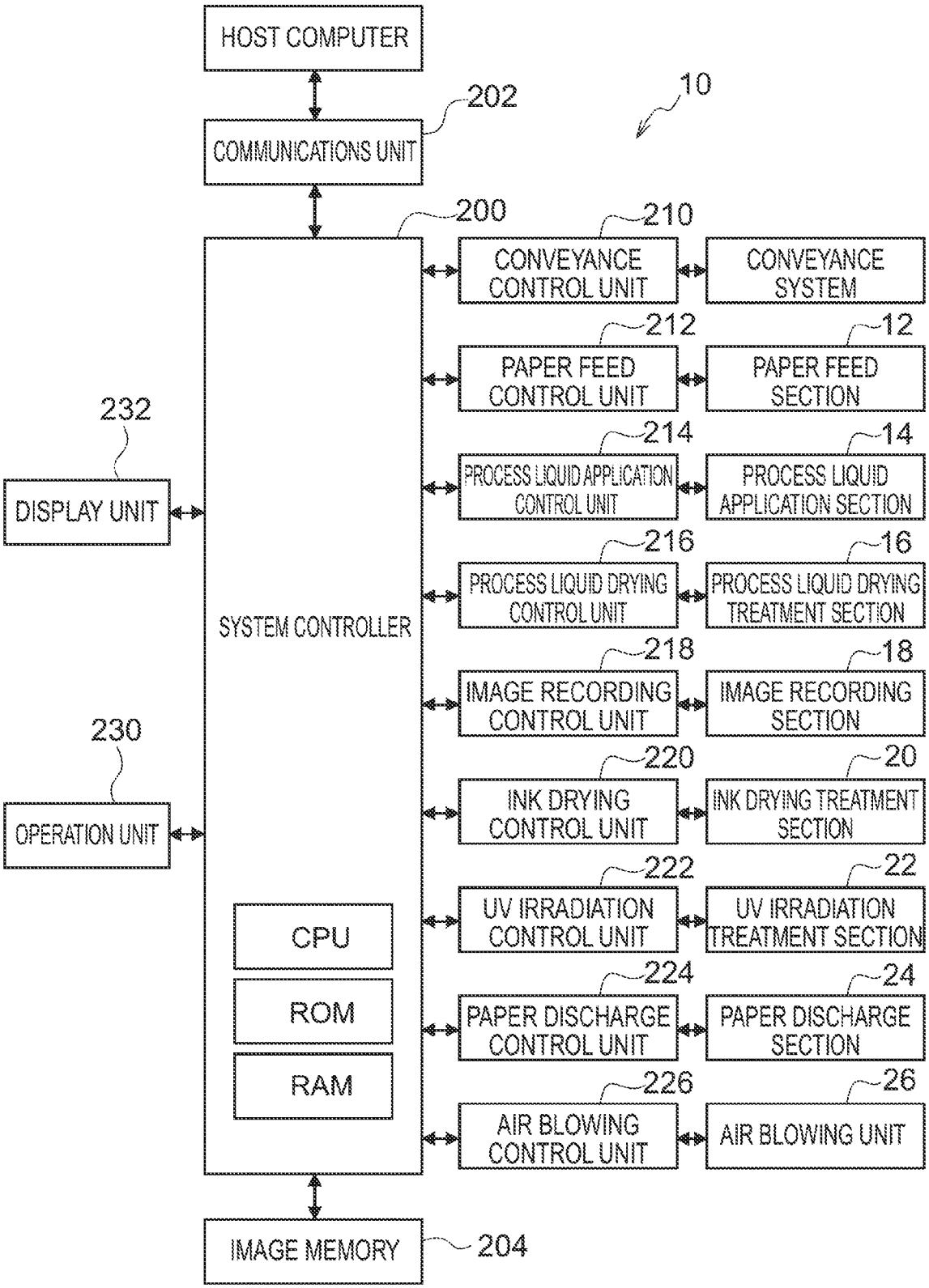
FIG. 5 is a block diagram showing the schematic configuration of a control system of an inkjet recording apparatus pertaining to the first embodiment of the present invention.

FIG. 5 is a block diagram showing the schematic configuration of a control system of the inkjet recording apparatus 10 pertaining to the first embodiment of the present invention.

As shown in FIG. 5, the inkjet recording apparatus 10 is equipped with a system controller 200, a communication unit 202, an image memory 204, a conveyance control unit 210, a paper feed control unit 212, a process liquid application control unit 214, a process liquid drying control unit 216, an image recording control unit 218, an ink drying control unit 220, a UV irradiation control unit 222, a paper discharge control unit 224, an air blowing control unit 226, an operation unit 230, a display unit 232, and so forth.

The system controller 200 functions as control means that exercises integrated control over each section of the inkjet recording apparatus 10 and functions as arithmetic means that performs various types of arithmetic processing. The system controller 200 is equipped with a CPU, a ROM, a RAM, and so forth and operates in accordance with a predetermined control program. The control program that the system controller 200 executes and various types of data needed for control are stored in the ROM.

The communication unit 202 is equipped with a required communication interface and transmits data to and receives data from a host computer connected to the communication interface.

The image memory 204 functions as temporary storage means for temporarily storing various types of data including image data. Data is read from and written to the image memory 204 through the system controller 200. Image data that have been imported from the host computer via the communication unit 202 are stored in the image memory 204.

The conveyance control unit 210 controls the conveyance system including the paper sheet P conveyance mechanism 90 in the recording medium conveyance device 11. That is, the conveyance control unit 210 controls the driving of the tape feeders 36A, the feed guide 38, and the paper feed drum 40 in the paper feed section 12 and controls the driving of the process liquid application drum 42 in the process liquid application section 14, the driving of the process liquid drying treatment drum 46 in the process liquid drying treatment section 16, and the driving of the image recording drum 52 in the image recording section 18. The conveyance control unit 210 also controls the driving of the chain gripper 64 and the back tension application mechanism 92 shared by the ink drying treatment section 20, the UV irradiation treatment section 22, and the paper discharge section 24.

The conveyance control unit 210 controls the conveyance system in accordance with a command from the system controller 200 in such a way that the paper sheet P is conveyed smoothly from the paper feed section 12 to the paper discharge section 24.

The paper feed control unit 212 controls the paper feed section 12 in accordance with a command from the system controller 200. Specifically, the paper feed control unit 212 controls the driving of the sucker device 32 and the paper feed tray raising-and-lowering mechanism such that the paper sheets P stacked in the paper feed tray 30 are sequentially supplied one sheet at a time without overlap.

The process liquid application control unit 214 controls the process liquid application section 14 in accordance with a command from the system controller 200. Specifically, the process liquid application control unit 214 controls the driving of the process liquid application unit 44 such that the process liquid is applied to the paper sheet P conveyed by the process liquid application drum 42.

The process liquid drying control unit 216 controls the process liquid drying treatment section 16 in accordance with a command from the system controller 200. Specifically, the process liquid drying control unit 216 controls the driving of the process liquid drying treatment unit 50 such that the paper sheet P conveyed by the process liquid drying treatment drum 46 is administered the drying treatment.

The image recording control unit 218 controls the image recording section 18 in accordance with a command from the system controller 200. Specifically, the image recording control unit 218 controls the driving of the inkjet heads 56C, 56M, 56Y, and 56K in such a way that a predetermined image is recorded on the paper sheet P conveyed by the image recording drum 52. The image recording control unit 218 also controls the operation of the inline sensor 58 such that the recorded image is read.

The ink drying control unit 220 controls the ink drying treatment section 20 in accordance with a command from the system controller 200. Specifically, the ink drying control unit 220 controls the driving of the ink drying treatment units 102 such that hot air is blown onto the paper sheet P conveyed by the chain gripper 64.

The UV irradiation treatment control unit 222 controls the UV irradiation treatment section 22 in accordance with a command from the system controller 200. Specifically, the UV irradiation control unit 222 controls the driving of the UV irradiation units 104 such that ultraviolet light is applied to the paper sheet P conveyed by the chain gripper 64.

The paper discharge control unit 224 controls the paper discharge section 24 in accordance with a command from the system controller 200. Specifically, the paper discharge control unit 224 controls the driving of the paper discharge tray raising-and-lowering mechanism and so forth in such a way that the paper sheets P are stacked in the paper discharge tray 76.

The air blowing control unit 226 controls the air blowing section 26 in accordance with a command from the system controller 200. Specifically, the air blowing control unit 226 controls the driving of the air blowing unit 70 such that the air blowing unit 70 blows air in diagonal directions from the center portion toward the side rear end portions at the upstream side of the paper sheet P conveyed by the image recording drum 52. More detailed control will be described later.

The operation unit 230 is equipped with required operating parts (e.g., operation buttons, a keyboard, a touch panel, etc.) and outputs to the system controller 200 operation information that has been inputted from the operating parts. The system controller 200 executes various types of processing in accordance with the operation information that has been inputted from the operation unit 230.

The display unit 232 is equipped with a required display device (e.g., an LCD panel or the like) and displays required information on the display device in accordance with a command from the system controller 200.

As described above, image data to be recorded on the paper sheets P is imported to the inkjet recording apparatus 10 via the communication unit 202 from the host computer. The imported image data are stored in the image memory 204.

The system controller 200 administers required signal processing to the image data stored in the image memory 204 to thereby generate dot data. Then, the system controller 200 controls the driving of the inkjet heads 56C, 56M, 56Y, and 56K of the image recording section 18 in accordance with the generated dot data and records on the paper sheets P the image that the image data represent.

The dot data are generated generally by performing color conversion processing and halftone processing with respect to the image data. Color conversion processing is processing that converts image data expressed by sRGB or the like (e.g., RGB 8-bit image data) into ink quantity data of each color of ink used by the inkjet recording apparatus 10 (in this example, the image data are converted into ink quantity data of each of the colors of C, M, Y, and K). Halftone processing is processing that converts the ink quantity data of each color generated by the color conversion processing into dot data of each color by processing such as error diffusion.

The system controller 200 performs color conversion processing and halftone processing with respect to the image data to thereby generate dot data of each color. Then, the system controller 200 controls the driving of the corresponding inkjet heads in accordance with the generated dot data of each color to thereby record on the paper sheets P the image that the image data represent.

Operation of the inkjet recording apparatus 10 of the present embodiment configured as described above is as follows.

When an instruction to start a print job is given to the system controller 200 via the operation unit 230, a cycle-up process is performed. That is, a preparatory operation is performed in each section so that stable operation can be performed.

When the cycle-up process is completed, the printing process is started. That is, the paper sheets P are successively fed from the paper feed section 12.

The paper feed section 12 feeds the paper sheets P stacked in the paper feed tray 30 one sheet at a time sequentially from the top with the sucker device 32. The paper sheets P that have been fed from the sucker device 32 are placed on the feeder board 36 one sheet at a time via the paper feed roller pair 34.

The paper sheets P that have been placed on the feeder board 36 are fed by the tape feeders 36A disposed on the feeder board 36 and are conveyed to the paper feed drum 40 while sliding on the feeder board 36. At this time, the paper sheets P that are successively fed are conveyed to the paper feed drum 40 while sliding on the feeder board 36 one sheet at a time without overlapping each other. As the paper sheets P are conveyed, the upper surfaces of the paper sheets P are pressed against the feeder board 36 by the retainers 36B. Because of this, unevenness of the paper sheets P is corrected.

The paper sheet P that has been conveyed to the terminal end of the feeder board 38 is transferred to the paper feed drum 40 after the leading end of the paper sheet P has been brought into contact with the feed guide 38. Because of this, the paper sheet P can be fed to the paper feed drum 40 with a fixed posture and without allowing the paper sheet P to slant.

The paper feed drum 40 receives the paper sheet P by gripping the leading end of the paper sheet P with the gripper 40A while rotating and conveys the paper sheet P toward the process liquid application section 14.

The paper sheet P that has been conveyed to the process liquid application section 14 is transferred from the paper feed drum 40 to the process liquid application drum 42.

The process liquid application drum 42 receives the paper sheet P by gripping the leading end of the paper sheet P with the gripper 40A while rotating and conveys the paper sheet P toward the process liquid drying treatment section 16. The application roller 44A is pressed against and brought into contact with the front surface of the paper sheet P as the paper sheet P is conveyed by the process liquid application drum 42, and the process liquid is applied to the front surface of the paper sheet P.

The paper sheet P to whose front surface the process liquid has been applied is transferred from the process liquid application drum 42 to the process liquid drying treatment drum 46.

The process liquid drying treatment drum 46 grips and receives the leading end of the paper sheet P while rotating and conveys the paper sheet P toward the image recording section 18. As the paper sheet P is conveyed by the process liquid drying treatment drum 46, hot air is blown from the process liquid drying treatment unit 50 onto the front surface of the paper sheet P, whereby the drying treatment is administered to the paper sheet P. Because of this, the solvent component in the process liquid is removed so that an aggregate layer of ink is formed on the front surface (image recording surface) of the paper sheet P.

The paper sheet P to which the process liquid drying treatment has been administered is transferred from the process liquid drying treatment drum 46 to the image recording drum 52.

The image recording drum 52 grips and receives the leading end of the paper sheet P while rotating and conveys the paper sheet P toward the ink drying treatment section 20. As the paper sheet P is conveyed by the image recording drum 52, liquid droplets of ink of each color of C, M, Y, and K are jetted onto the front surface of the paper sheet P by the inkjet heads 56C, 56M, 56Y, and 56K, whereby an image is recorded on the paper sheet P. The image that has been recorded as the paper sheet P is conveyed is read by the inline sensor 58. At this time, the paper sheet P is conveyed while being sucked and held on the peripheral surface 53 of the image recording drum 52. Additionally, the recording of the image and the reading of the recorded image are performed in this state in which the paper sheet P is sucked and held. Because of this, the image can be recorded with high precision and the reading of the image can be performed with high precision.

The paper sheet P is released from the sucking and holding at the end-of-suction position set between the installation position of the inline sensor 58 and the air blowing section 26. The paper sheet P that has been released from the sucking and holding is conveyed toward the air blowing section 26 after the leading end of the paper sheet P has passed the contact prevention plate 59 by the rotation of the image recording drum 52.

The air blowing unit 70 of the air blowing section 26 blows air in diagonal directions from the center portion toward the side portions at the upstream side of the paper sheet P (the side rear end portions of the paper sheet P) being conveyed by the image recording drum 52 to thereby press the paper sheet P against the outer peripheral surface 53 of the image recording drum 52.

The paper sheet P to which the air blowing treatment has been administered is transferred from the image recording drum 52 to the chain gripper 64.

The chain gripper 64 grips the leading end of the paper sheet P with the gripper 64D disposed on the traveling chain 64C, receives the paper sheet P, and conveys the paper sheet P toward the paper discharge section 24.

As the paper sheet P is conveyed by the chain gripper 64, first, the ink drying treatment is administered to the paper sheet P. That is, hot air is blown toward the front surface of the paper sheet P from the ink drying treatment units 102 installed in the first horizontal conveyance path 94A. At this time, the paper sheet P is conveyed while its back surface is sucked by the guide plate 96, and back tension is applied to the paper sheet P (this process is called a suction conveyance process). Because of this, the drying treatment can be administered while suppressing deformation of the paper sheet P.

After the paper sheet P passes through the ink drying treatment section 20 and the drying treatment ends, next, the UV irradiation treatment is administered to the paper sheet P. That is, ultraviolet light is applied toward the front surface of the paper sheet P from the UV irradiation units 104 installed on the inclined conveyance path 94B. The ink configuring the image is cured and the image becomes fixed to the paper sheet P. At this time, the paper sheet P is conveyed while its back surface is sucked by the guide plate 96, and back tension is applied to the paper sheet P. Because of this, the fixing process can be administered while suppressing deformation of the paper sheet P.

After the paper sheet P passes through the UV irradiation treatment section 22 and the UV irradiation treatment ends, the paper sheet P is conveyed toward the paper discharge section 24, is released from the gripper 64D in the paper discharge section 24, and is stacked in the paper discharge tray 76.

The image recording process is completed by the series of operations described above. As described above, the paper sheets P are continuously fed from the paper feed section 12, and the image recording process is continuously performed with each section for the continuously fed paper sheets P.

Here, in the first embodiment of the present invention, the air blowing control unit 226 controls the air blowing unit 70 as described below before and after the air blowing by the air blowing unit 70.

Figure 6A:
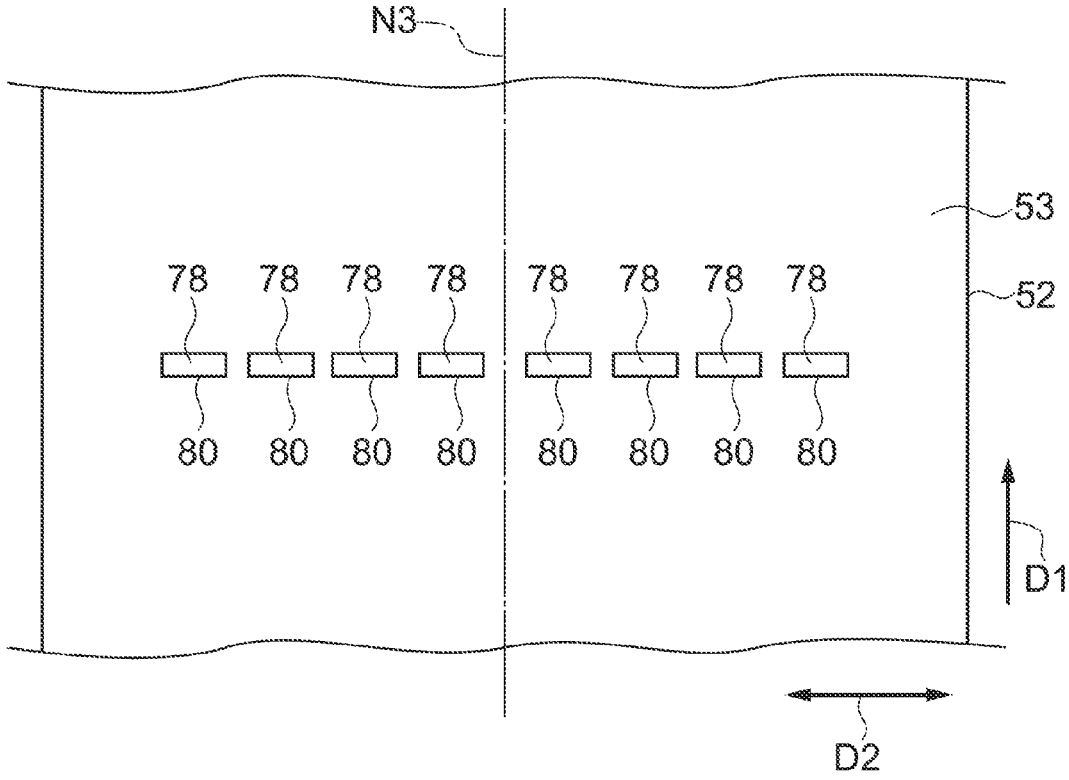
FIG. 6A is a plan view showing the state of inclination of nozzles of the air blowing unit before control by an air blowing control unit.
Figure 6B:
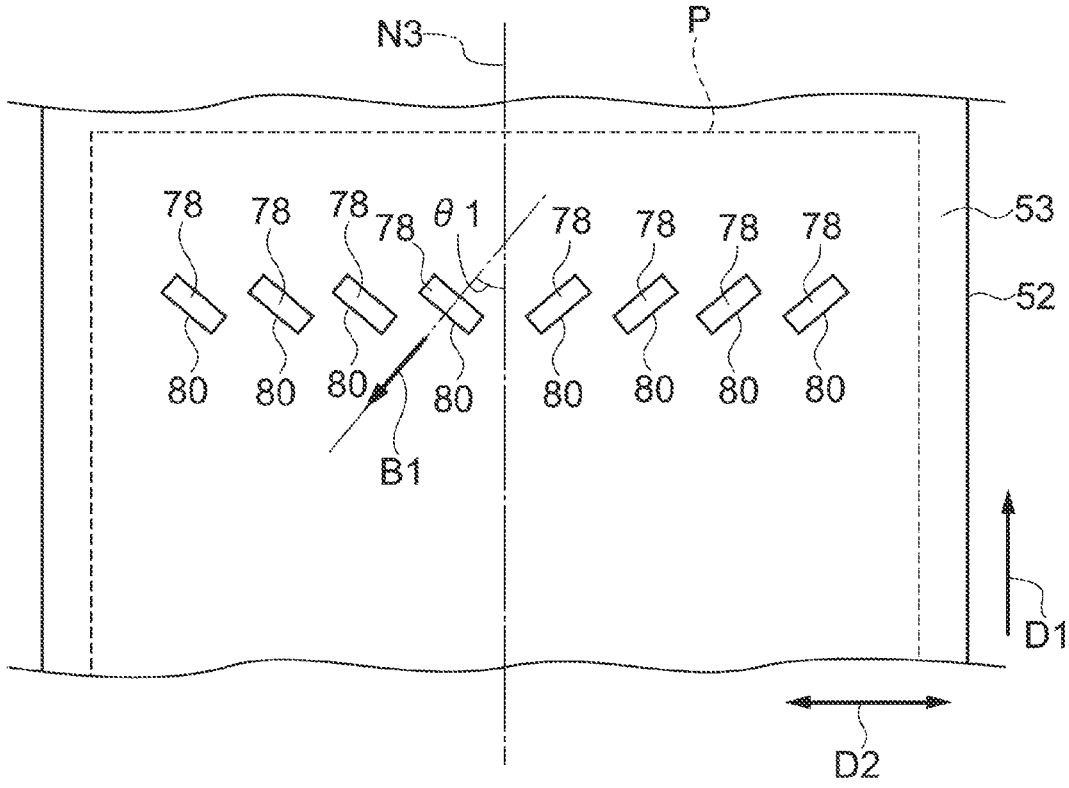
FIG. 6B is a plan view showing the state of inclination of the nozzles of the air blowing unit after control by the air blowing control unit.

FIG. 6A is a plan view showing a state of the nozzles 78 of the air blowing unit 70 before control by the air blowing control unit 226. FIG. 6B is a plan view showing a state of inclination of the nozzles 78 of the air blowing unit 70 after control by the air blowing control unit 226.

As shown in FIG. 6A, the state of the nozzles 78 of the air blowing unit 70 before control is such that, when the nozzles 78 are seen in a plan view, the nozzles 78 are lined up parallel with respect to a centerline N3 of the paper sheet P along the conveyance direction D1 (which is identical to the centerline of the outer peripheral surface 53 of the image recording drum 52 along the conveyance direction D1). In other words, the nozzles 78 are not inclined with respect to the width direction D2 of the outer peripheral surface 53, and the angle of inclination θ1 of the nozzles 78 (θ1 is also the angle from the centerline N1 of the air blowing unit 70) is 0°.

Then, before the air from the air blowing unit 70 strikes the paper sheet P such as, for example, when the image recording drum 52 has received the paper sheet P from the process liquid drying treatment drum 46, as shown in FIG. 6B, the air blowing control unit 226 controls the air blowing unit 70 to adjust the angle of inclination θ1 of the nozzles 78 such that, in the air blowing section 26, the air B1 can be blown in diagonal directions from the center portion toward the side portions at the upstream side of the paper sheet P (the upstream side in the conveyance direction D1). That is, the air blowing control unit 226 adjusts the angle of inclination of the nozzles 78 in such a way that, when the nozzles 78 are seen in a plan view, the directions in which the air B1 is blown from the nozzles 78 become inclined by angle θ1 (or −θ1) with respect to the centerline N3 in the directions of the side portions of the paper sheet P at the upstream side. In the first embodiment, when the air blowing control unit 226 adjusts the angle of inclination of the nozzles 78, the four nozzles 78 communicated with the air volume regulation unit 76A all have the same angle of inclination θ1 and the four nozzles 78 communicated with the air volume regulation unit 76B all have the same angle of inclination −θ1.

Figure 7A:
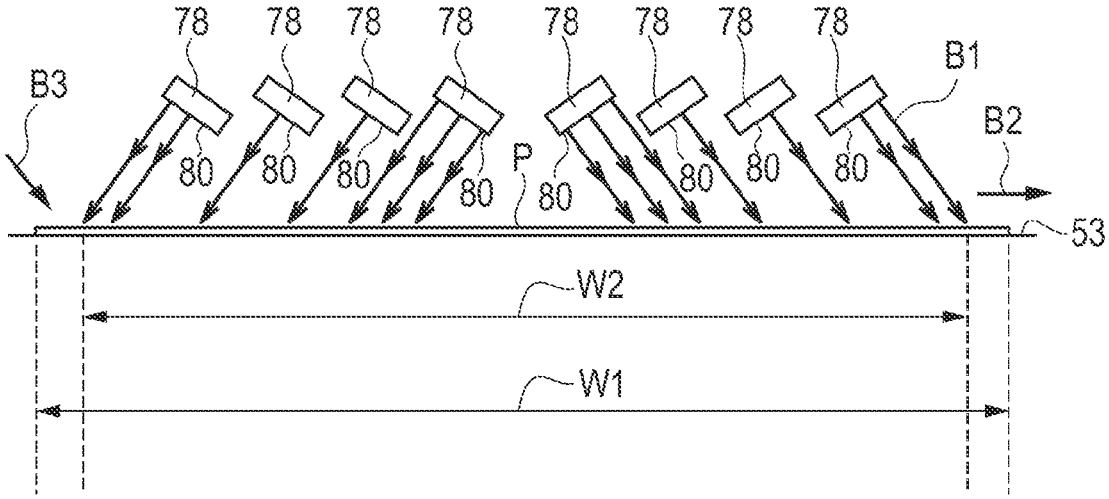
FIG. 7A is a plan view showing the state of inclination of the nozzles of the air blowing unit before control by the air blowing control unit.
Figure 7B:
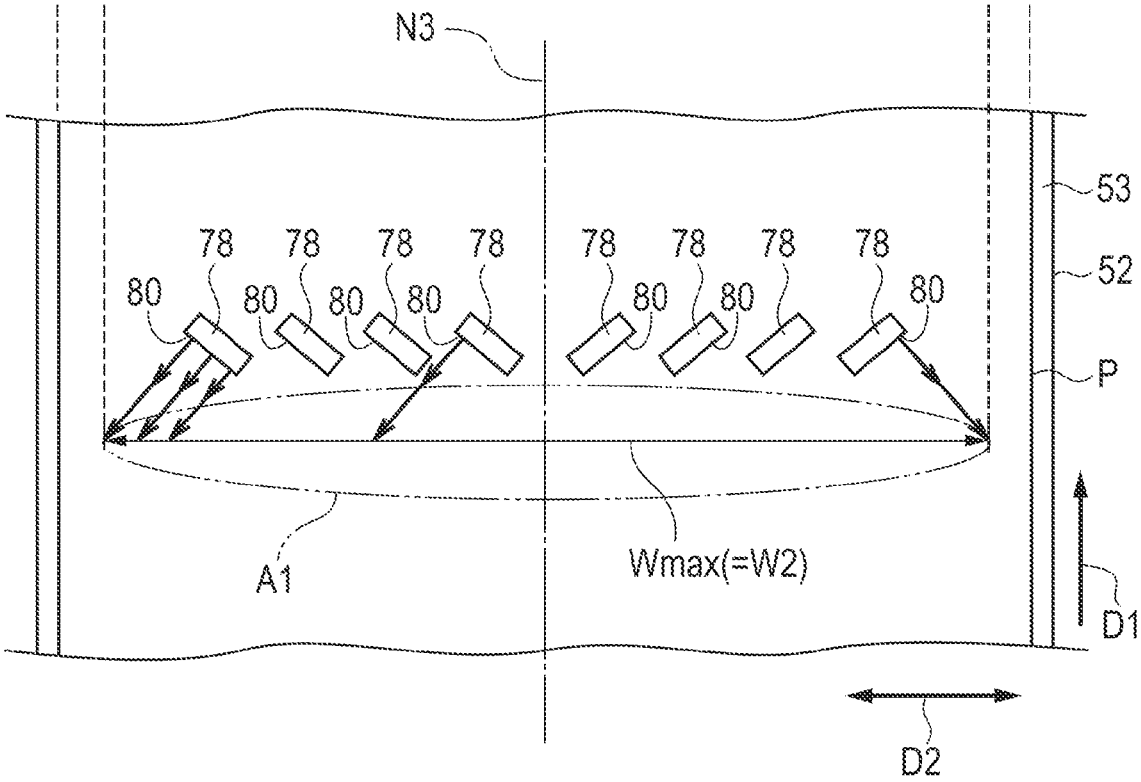
FIG. 7B is a plan view showing the state of inclination of the nozzles of the air blowing unit after control by the air blowing control unit.
Figure 8A:
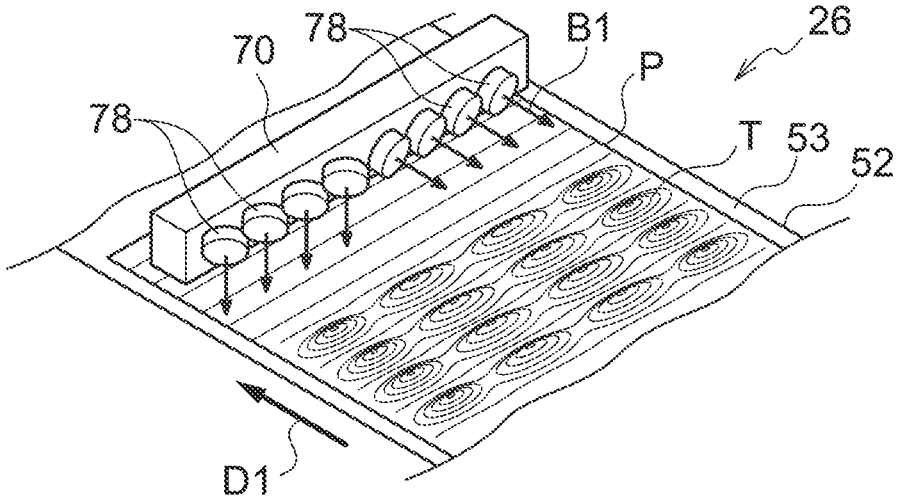
FIGS. 8A to 8D are views showing, in the order of conveyance, states of a paper sheet passing through an air blowing section.
Figure 8B:
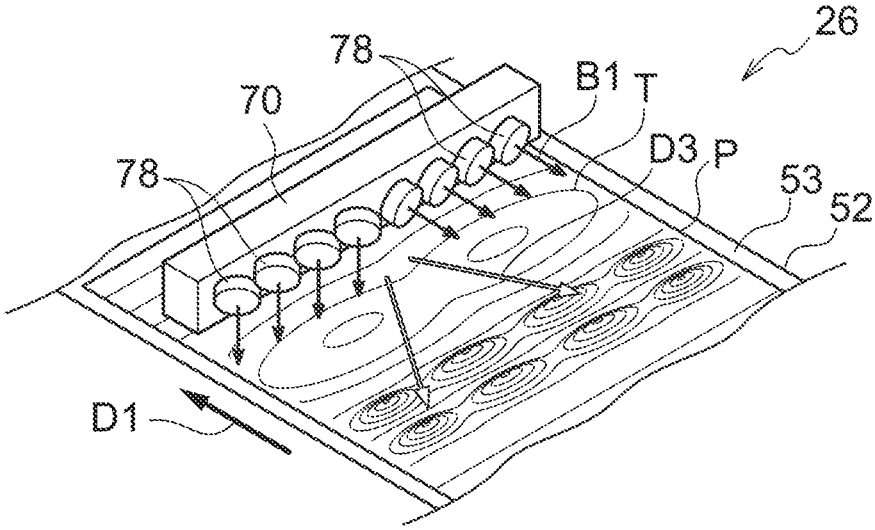
Figure 8C:
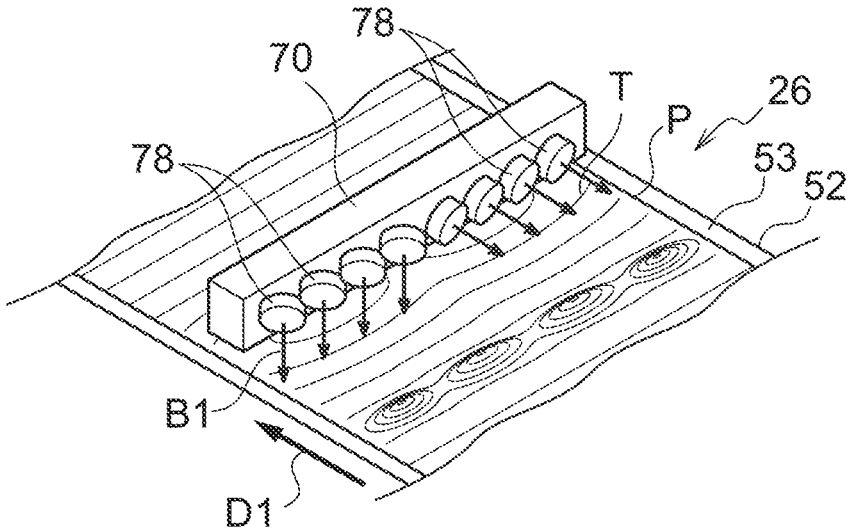
Figure 8D:
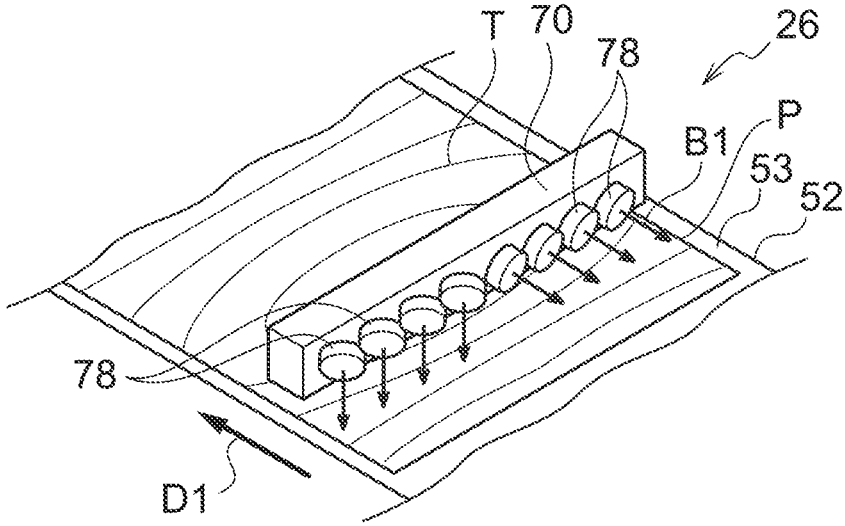

FIG. 7A is a plan view showing the state of inclination of the nozzles 78 of the air blowing unit 70 before control by the air blowing control unit 226. FIG. 7B is a plan view showing the state of inclination of the nozzles 78 of the air blowing unit 70 after control by the air blowing control unit 226.

When the air blowing control unit 226 adjusts the angle of inclination θ1, as shown in FIG. 7A, the air blowing control unit 226 controls the air blowing unit 70 to adjust the angle of inclination θ1—that is, the directions in which the air B1 is blown—in such a way that a width W2 of an air blowing region in which all of the air B1 is blown by the air blowing unit 70 becomes narrower than a width W1 of the paper sheet P conveyed from the image recording drum 52 to the conveyance mechanism 90.

The width W2 of the air blowing region means a width of a range covered by the air B1 that directly strikes the paper sheet P from the nozzles 78 and does not include a width of a range covered by air B2 that flows along the paper sheet P after striking the paper sheet P or a width of a range of air B3 in which the air B2 strikes outside members (such as the outer peripheral surface 53) and bounces back.

As shown in FIG. 7B, the air B1 spreads not only in the width direction D2 of the outer peripheral surface 53 of the image recording drum 52 but also in the conveyance direction D1, so an air blowing region A1 of the blown air B1 can take various widths in the width direction D2 of the outer peripheral surface 53, but a width Wmax that is the longest among those various widths is defined as the width W2 of the air blowing region.

Next, immediately after the paper sheet P has passed the inline sensor 58, the air blowing control unit 226 controls the air blowing unit 70 so as to start blowing the air B1 from the nozzles 78, continues to have the air blowing unit 70 blow the air B1 until the paper sheet P passes through at least the air blowing section 26, and has the air blowing unit 70 stop blowing the air B1 until the image recording drum 52 receives the next paper sheet P from the process liquid drying treatment drum 46. Thereafter, the air blowing control unit 226 controls the air blowing unit 70 to return the state of inclination of the nozzles 78 of the air blowing unit 70 from the state shown in FIG. 6B to the state shown in FIG. 6A, which is an initial state before control by the air blowing control unit 226.

FIGS. 8A to 8D are views showing, in the order of conveyance, states of the paper sheet P passing through the air blowing section 26.

As shown in FIGS. 8A to 8D, the air blowing control unit 226 controls the air blowing unit 70 to adjust beforehand the angle of inclination θ1 of the nozzles 78 in such a way that the air blowing unit 70 can blow the air B1 in diagonal directions as explained above. Consequently, when the paper sheet P passes through the air blowing section 26, the entire air blowing unit 70 blows air in diagonal directions D3 from the center portion toward the side portions at the upstream side of the paper sheet P. Because of this, a force that causes the paper sheet P to expand in the diagonal directions D3 from the center portion toward the side portions at the upstream side of the paper sheet P can be applied in accompaniment with the progression of the conveyance before the paper sheet P is restrained by the suction conveyance by the conveyance mechanism 90. Because of this, paper sheet deformation strain T (wrinkling, curling, cockling, etc.) occurring in the center portion of the paper sheet P can be dispersed (smoothed out) in the directions toward the side rear ends of the paper sheet P or removed. Consequently, when the paper sheet P is conveyed by the chain gripper 64 and the suction by the suction fans 100 starts, the paper sheet deformation strain T in the paper sheet P have been dispersed or eliminated, and wrinkling of the paper sheet P at the time of the suction conveyance can be suppressed.

Further, under the control of the air blowing control unit 226, before the air B1 strikes the paper sheet P, the air blowing unit 70 adjusts the directions in which the air B1 is blown in such a way that the width W2 of the air blowing region of the air B1 becomes narrower than the width W1 of the paper sheet P conveyed from the image recording drum 52 to the conveyance mechanism 90. Consequently, a situation where the air B1 goes outside the paper sheet P, strikes the outer peripheral surface 53 of the image recording drum 52 or the like, bounces back, and end ups traveling around to the back surface of the paper sheet P can be prevented. Because of this, lift with respect to the paper sheet P can be suppressed and flapping of the paper sheet P at the time of the air blowing can be suppressed.

As described above, according to the inkjet recording apparatus 10 and the recording medium conveyance device 11 pertaining to the first embodiment of the present invention, both wrinkling of the paper sheet P at the time of the suction conveyance and flapping of the paper sheet P at the time of the air blowing can be suppressed.

Here, the air blowing control unit 226 may control the air volume regulation units 76A and 76B of the air blowing unit 70 in such a way that the volumes of air from the nozzles 78 become the same at the time of the air blowing, but it is preferred that the air blowing control unit 226 increase the air volume in the center portion in the width W2 of the air blowing region. This is because the paper sheet deformation strain T tends to concentrate in the center portion in the width W2 of the air blowing region, that is, in the center portion of the paper sheet P, so by increasing the air volume in the center portion in the width W2 of the air blowing region, even more of the paper sheet deformation strain T can be dispersed in the directions toward the side rear ends of the paper sheet P or removed.

The air blowing control unit 226 may also be configured to increase the air volume to be greater with respect to a drawn section of the paper sheet P where the liquid droplets have been jetted than the air volume with respect to a non-drawn section. By increasing the air volume with respect to the drawn section that tends to rise because of the liquid droplets than the air volume with respect to the non-drawn section, lifting of the drawn section can be suppressed. In this case, in the event that the drawn section and the non-drawn section are strictly segregated, it becomes difficult to adjust the air volume, and the air blowing control unit 226 may control such as, for example, dividing the paper sheet P into ten or fewer simple areas, judging whether or not there is a drawn section in each area, blowing air onto an area in which there is a drawn section, and not blowing air onto an area in which there is no drawn section.

The air volume of the blown air differs depending on the width W1 and the rigidity of the paper sheet P, but in the case of blowing air with respect to Kikuban size (a length of 939 mm and a width of 636 mm) paper sheets P, it is preferred that the air volume be equal to or greater than 0.1 $m^3$/min and equal to or less than 2.0 $m^3$/min.

It is preferred that the air blowing control unit 226 adjust the directions in which the air B1 is blown in such a way that the width of the air blowing region becomes equal to 50% to 95% of the width W1 of the paper sheet P. This is because if the width W2 of the air blowing region is equal to or greater than 50% of the width W1 of the paper sheet P, the effect of pressing the side end portions of the paper sheet P can be enhanced. This is also because if the width W2 of the air blowing region is equal to or less than 95% of the width W1 of the paper sheet P, flapping of the paper sheet P can be suppressed even more. In the case of thin paper which is apt to deform and flap, from the standpoint of reliably preventing flapping it is preferred that the air blowing control unit 226 adjust the directions in which the air B1 is blown in such a way that the width W2 of the air blowing region becomes equal to 60% to 87.5% of the width W1 of the paper sheet P. In the case of jetting a large quantity of ink with respect to thin paper, paper sheet deformation becomes greater because of the absorption of the ink and it becomes easier for the paper to flap, so from the standpoint of deterring this it is more preferred that the air blowing control unit 226 adjust the directions in which the air B1 is blown in such a way that the width W2 of the air blowing region becomes equal to 70% to 80% of the width W1 of the paper sheet P.

It is preferred that the air blowing control unit 226 adjust the directions in which the air B1 is blown in such a way that the directions are inclined 5° or more and 45° or less to the side portions in the upstream side with respect to the centerline N3 of the paper sheet P. When the air blowing control unit 226 adjusts the directions in which the air B1 is blown to be inclined 5° or more to the side portions at the upstream side with respect to the centerline N3 of the paper sheet P, it can be made easier to disperse the paper sheet deformation strain T to the side at rear end portion of the paper sheet P. Additionally, the directions in which the air B1 is blown is adjusted to be inclined 45° or less to the side portions at the upstream side with respect to the centerline N3 of the paper sheet P, although it also depends on the width W1 of the paper sheet P and the height of the nozzles 78 from the outer peripheral surface 5, a situation where the air B1 strikes the paper sheet P, bounces back, and directly escapes to the outside of the paper sheet P can be suppressed, and the paper sheet P becomes less possible to flap.

Figure 9A:
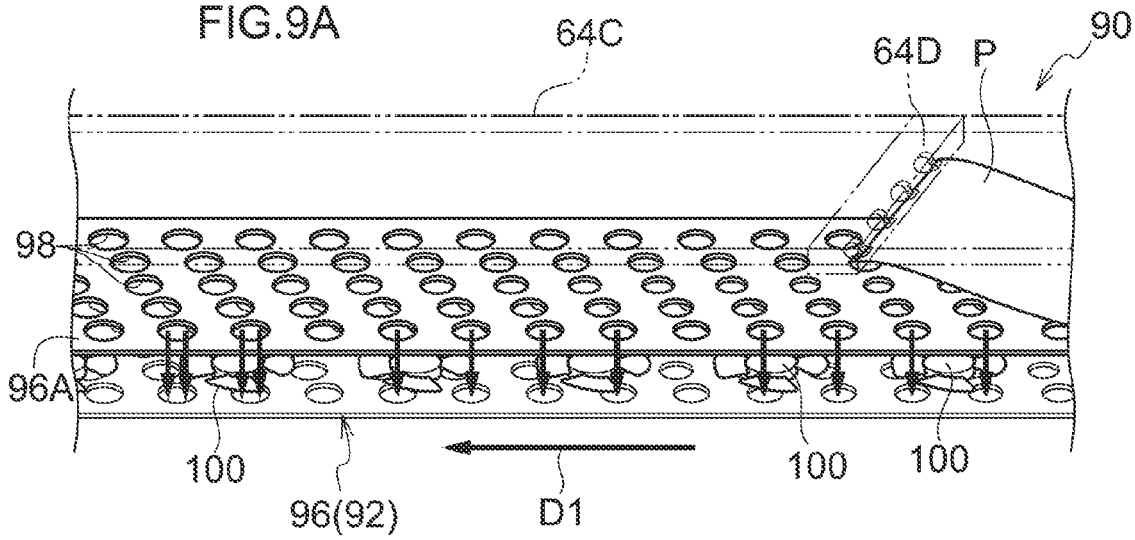
FIGS. 9A to 9C are views showing, in the order of conveyance, states of the paper sheet at the time of suction conveyance by a conveyance mechanism.
Figure 9B:
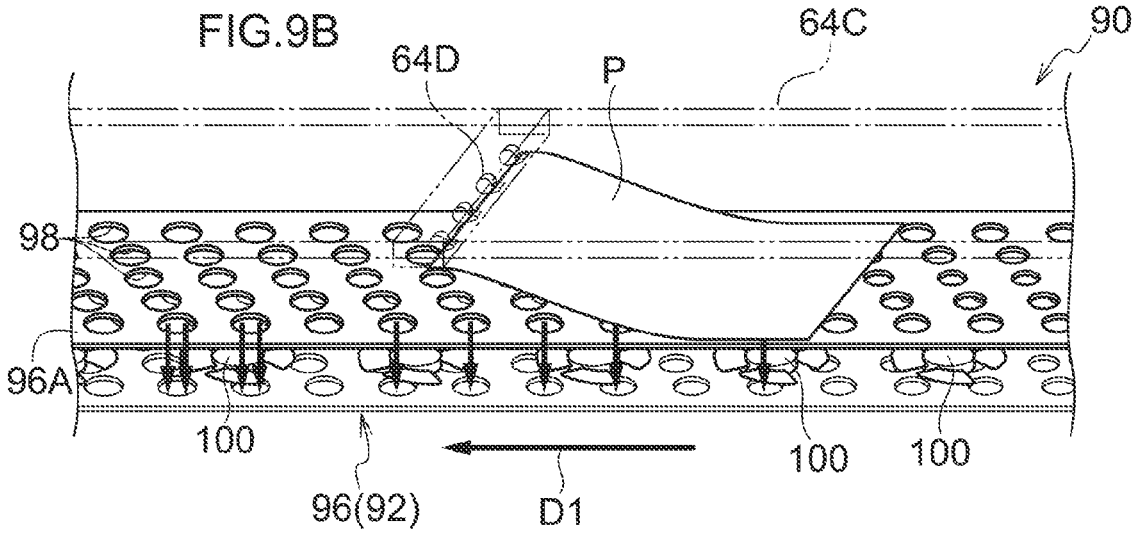
Figure 9C:
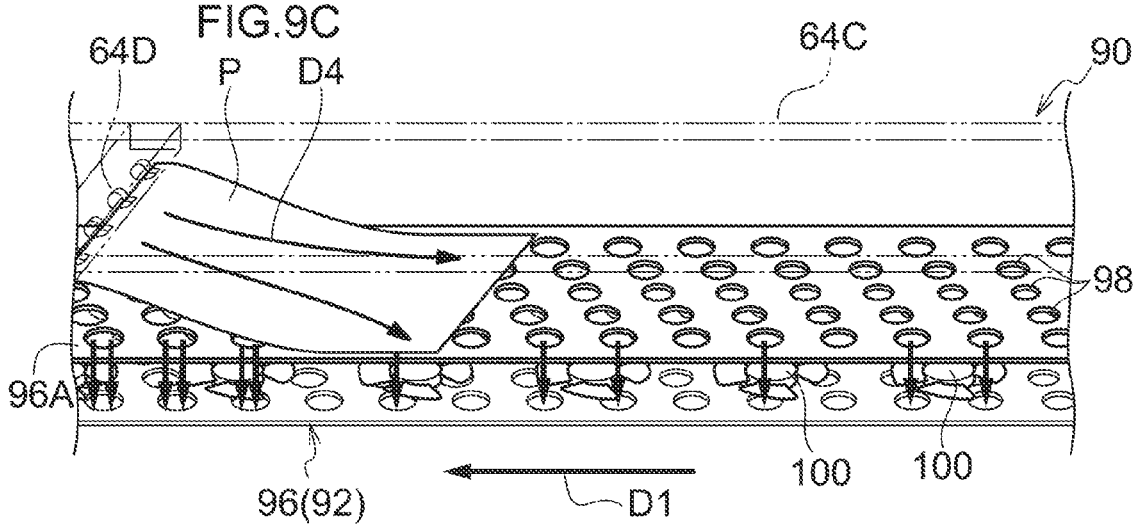

FIGS. 9A to 9C are views showing, in the order of conveyance, states of the paper sheet P at the time of the suction conveyance by the conveyance mechanism 90.

As shown in FIGS. 9A to 9C, the conveyance mechanism 90 is equipped with the chain gripper 64 that grips and conveys the leading end of the paper sheet P and the back tension application mechanism 92 that sucks, onto the sliding contact surface 96A, the paper sheet P conveyed by the chain gripper 64. The paper sheet P is conveyed, with its leading end gripped by the chain gripper 64, while being sucked onto the sliding contact surface 96A of the guide plate 96 by the suction fans 100 of the back tension application mechanism 92. For this reason, compared to a case where the paper sheet P is tightly sucked onto (brought into close contact with) the sliding contact surface 96A of the guide plate 96 and is conveyed integrally with the sliding contact surface 96A, a force with which the paper sheet P is restrained is weaker and wrinkling of the paper sheet P at the time of the suction conveyance and particularly at the time when the suction starts can be suppressed.

In the first embodiment, the suction holes 98 are disposed in the sliding contact surface 96A, and the opening area of the suction holes 98 is increased in a stepwise manner from the upstream side toward the downstream side in the conveyance direction D1 of the paper sheet P, so the suction volume for the paper sheet P increases in a stepwise manner in accompaniment with the conveyance (assuming that the suction volumes resulting from the suction fans 100 are all the same) and abrupt changes in the suction volume with respect to the paper sheet P at the time of the suction conveyance can be suppressed. Because of this, wrinkling of the paper sheet P caused by the suction at the time of the conveyance can be suppressed.

The opening area of the suction holes 98 is also increased in a stepwise manner from the center portion toward the width direction side end portions of the sliding contact surface 96A. In this way, when the opening area is increased in a stepwise manner from the upstream side toward the downstream side in the conveyance direction D1 and is increased in a stepwise manner from the center portion toward the side end portions of the sliding contact surface 96A, as shown in FIG. 9C, a force that causes the paper sheet P to expand in diagonal directions D4 from the center portion to the side rear end portions of the paper sheet P in accompaniment with the progression of the conveyance of the paper sheet P on the sliding contact surface 96A can be applied, and the paper sheet deformation strain T that tends to occur in the center portion of the paper sheet P can be dispersed to the side rear end portions or removed.

Particularly in a case where the on-and-off control of the entire suction region of the sliding contact surface 96A can only be performed at the same time, in a case where the size of the paper sheet P is large and the timing of the start of the suction is delayed, there is a concern that a certain time will be necessary until the start of the suction for the leading end portion of the paper sheet P. Even in such a case, stepwise suction can be started because the opening area of the suction holes 98 is increased in a stepwise manner from the upstream side in the conveyance direction D1 of the paper sheet P toward the downstream side.

Hot air is blown by the ink drying treatment units 102 onto the front surface of the paper sheet P while the paper sheet P is being sucked and conveyed by the conveyance mechanism 90, whereby the drying treatment is administered to the front surface of the paper sheet P. Consequently, drying can be promoted in a state in which the paper sheet deformation strain T is suppressed, and the amount of the paper sheet deformation strain after paper discharge can be reduced even more. Ultraviolet (UV) light is applied by the UV irradiation treatment section 22 to the front surface of the paper sheet P (the image that has been recorded using water-based UV ink) while the paper sheet P is being sucked and conveyed after the drying treatment, whereby the image becomes fixed to the front surface of the paper sheet P. Consequently, fixing can be promoted in a state in which the paper sheet deformation strain T is suppressed, and the amount of the paper sheet deformation strain after paper discharge can be reduced even more.

In the inkjet recording apparatus 10 pertaining to the first embodiment, the air blowing section 26 is disposed between the inkjet heads 56C, 56M, 56Y, and 56K and the conveyance mechanism 90 along the conveyance direction D1, so after the drawing of the image by the inkjet heads 56C, 56M, 56Y, and 56K, the paper sheet deformation strain T in the paper sheet P can be dispersed from the center portion to the side rear end portions of the paper sheet P or removed by the air blowing section 26. Then, because the paper sheet P is sucked and conveyed by the conveyance mechanism 90 without an interval, the paper sheet deformation strain T can be suppressed from occurring again before the paper sheet P is conveyed by the conveyance mechanism 90.

Second Embodiment

Next, a recording medium conveyance device and an image forming apparatus pertaining to a second exemplary embodiment of the present invention will be described specifically with reference to the attached drawings.

Configuration of Image Forming Apparatus

Figure 10:
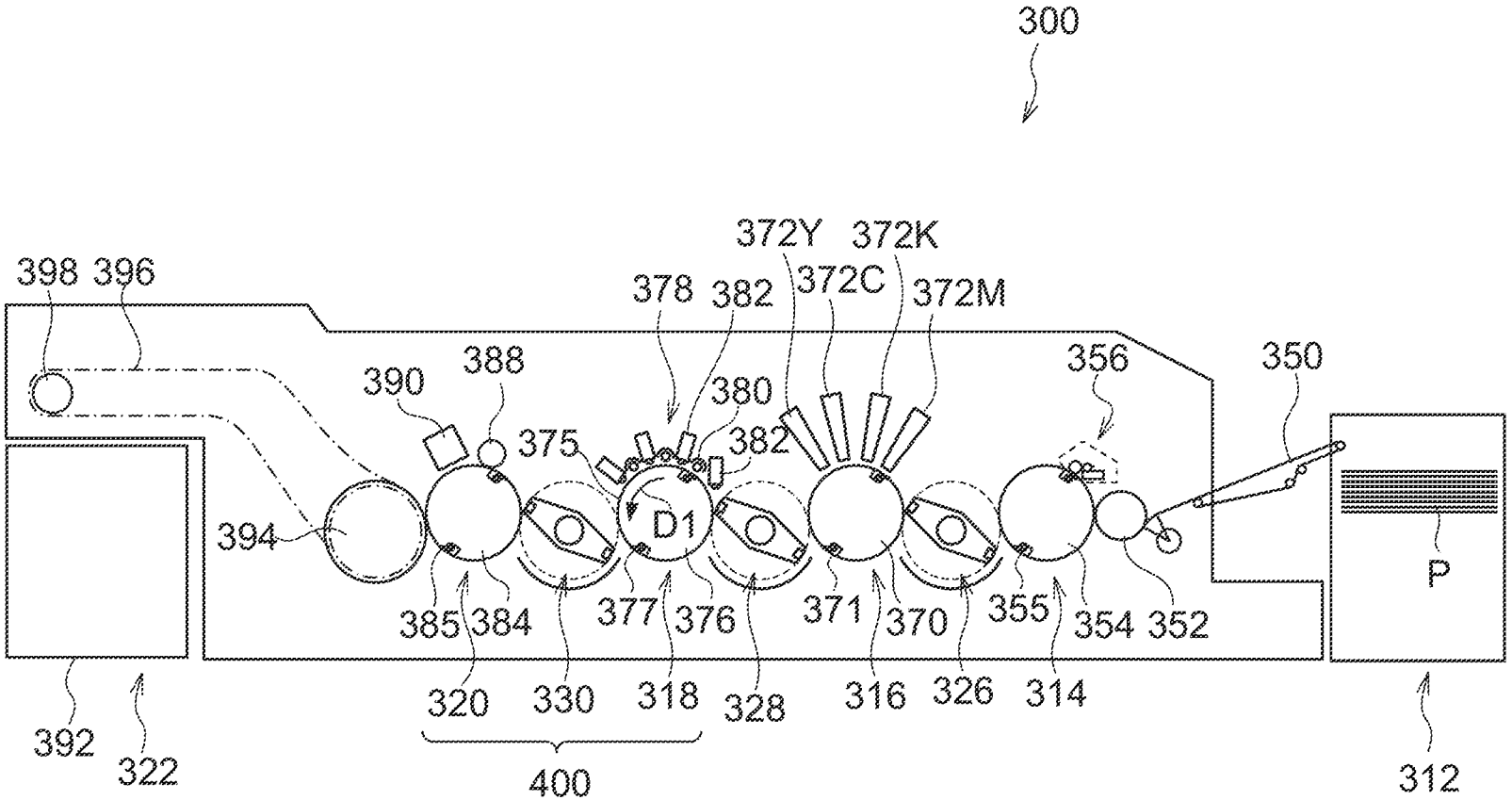
FIG. 10 is a diagram showing the overall configuration of an image forming apparatus pertaining to a second embodiment of the present invention.

FIG. 10 is a diagram showing the overall configuration of the image forming apparatus pertaining to the second embodiment of the present invention.

The image forming apparatus is an inkjet recording apparatus 300 that is equipped with a recording medium conveyance device 400 and in which the location of the blowing section of the recording medium conveyance device and the configuration of the conveyance mechanism differ from those in the first embodiment.

The inkjet recording apparatus 300 is mainly configured to include a paper feed section 312, a process liquid application section 314, a drawing section 316, a drying section 318 that also has the function of the blowing section 26 of the first embodiment, a fixing section 320, and a paper discharge section 322.

The paper feed section 312 is a mechanism that supplies paper sheets P to the process liquid application section 314. The paper sheets P are stacked in the paper feed section 312. A paper feed tray 350 is disposed in the paper feed section 312. The paper sheets P are fed one sheet at a time from the paper feed tray 350 to the process liquid application section 314.

The process liquid application section 314 is a mechanism that applies a process liquid to recording surfaces of the paper sheets P.

The process liquid application section 314 is equipped with a paper feed cylinder 352, a process liquid drum 354, and a process liquid application device 356. The process liquid drum 354 holds, rotates, and conveys the paper sheets P. The process liquid drum 354 is equipped with claw-shaped holding parts (grippers) 355 on its outer peripheral surface and can hold the leading ends of the paper sheets P by sandwiching the paper sheets P between the claws of the holding part 355 and a peripheral surface of the process liquid drum 354. The process liquid drum 354 may also be configured that suction holes are disposed in its outer peripheral surface and a suction part that performs suction from the suction holes is connected to the process liquid drum 354. Because of this, the paper sheets P can be closely held on the peripheral surface of the process liquid drum 354.

The process liquid application device 356 is disposed at the outer side of the process liquid drum 354 so as to oppose the peripheral surface of the process liquid drum 354. The process liquid is applied to the recording surfaces of the paper sheets P by the process liquid application device 356.

The paper sheets P to which the process liquid has been applied by the process liquid application section 314 are transferred from the process liquid drum 354 via an intermediate conveyance section 326 (a first transfer cylinder) to a drawing drum 370 of the drawing section 316.

The drawing section 316 is equipped with the drawing drum 370 and inkjet heads 372M, 372K, 372C, and 372Y.

The drawing drum 370 is, like the process liquid drum 354, equipped with claw-shaped holding parts (grippers) 371 on its outer peripheral surface and is configured to hold and secure the leading end portion of the recording medium. Further, the drawing drum 370 has plural suction holes in its outer peripheral surface and uses negative pressure to suck the paper sheets P onto the outer peripheral surface of the drawing drum 370.

The paper sheets P that have been secured to the drawing drum 370 in this way are conveyed with their recording surfaces facing outward, and ink is jetted from the inkjet heads 372M, 372K, 372C, and 372Y onto the recording surfaces of the paper sheets P.

Liquid droplets of corresponding color ink are jetted from the inkjet heads 372M, 372K, 372C, and 372Y toward the recording surfaces of the paper sheets P that are closely held on the drawing drum 370, whereby the ink contacts the process liquid that has been applied beforehand to the recording surfaces by the process liquid application section 314, the color materials (pigments) dispersed in the ink aggregate, and a color material aggregate is formed. Because of this, color material flow on the paper sheets P is prevented, and images are formed on the recording surfaces of the paper sheets P.

The drawing section 316 configured as described above can perform drawing in a single pass with respect to the paper sheets P. Because of this, high-speed recording and high-speed output are possible, and productivity can be enhanced.

The paper sheets P on which the images have been formed by the drawing section 316 are transferred from the drawing drum 370 via an intermediate conveyance section 328 (a second transfer cylinder) to a drying drum 376 of the drying section 318.

The drying section 318 is a mechanism that dries moisture included in a solvent separated by the color material aggregating action. As shown in FIG. 10, the drying section 318 is equipped with the drying drum 376 and a solvent drying device 378.

The drying drum 376 is, like the process liquid drum 354, equipped with claw-shaped holding parts (grippers) 377 on its outer peripheral surface 375, holds the leading end of the paper sheet P with the holding parts 377, has suction holes (not illustrated) in a drum outer peripheral surface 375, and is configured such that it can use negative pressure to suck the paper sheets P onto the drying drum 376.

The solvent drying device 378 is placed in a position opposing the outer peripheral surface 375 of the drying drum 376 and has a configuration where combinations of IR heaters 380 and warm air nozzles 382 are plurally placed. By adjusting as appropriate a temperature and an air volume of the hot air blown toward the paper sheets P from the warm air nozzles 382, various drying conditions can be realized. The paper sheets P are conveyed with their recording surfaces facing outward on the outer peripheral surface 375 of the drying drum 376, and drying treatment by the IR heaters 380 and the warm air nozzles 382 is performed with respect to the recording surfaces.

Further, the drying drum 376 is configured that the suction holes are disposed in its outer peripheral surface 375 and has a suction part that performs suction from the suction holes. Because of this, the paper sheets P can be closely held on the outer peripheral surface 375 of the drying drum 376. Further, by performing negative pressure suction, the paper sheets P can be restrained on the drying drum 376, so cockling of the paper sheets P can be prevented.

The paper sheets P on which the drying treatment has been performed by the drying section 318 are transferred from the drying drum 376 via an intermediate conveyance section 330 (a third transfer cylinder) to a fixing drum 384 of the fixing section 320.

The fixing section 320 is configured by the fixing drum 384, a pressing roller 388 (smoothing part), and an inline sensor 390. The fixing drum 384 is, like the process liquid drum 354, equipped with claw-shaped holding parts (grippers) 385 on its outer peripheral surface and is configured to hold the leading ends of the paper sheets P with the holding parts 385.

The paper sheets P are conveyed with their recording surfaces facing outward by the rotation of the fixing drum 384. Smoothing treatment by the pressing roller 388 is performed and fixing of the ink is performed with respect to the recording surfaces of the paper sheets P.

The pressing roller 388 smoothes the paper sheets P by applying pressure to the paper sheets P on which the ink has been dried. The inline sensor 390 measures a check pattern on the paper sheets P, a moisture content, a surface temperature, glossiness, and so forth. A CCD line sensor, for example, can be suitably used for the inline sensor 390.

The paper discharge section 322 is disposed following the fixing section 320. A paper discharge unit 392 is installed in the paper discharge section 322. A fourth transfer cylinder 394 and a conveyance chain 396 are disposed between the fixing drum 384 of the fixing section 320 and the paper discharge unit 392. The conveyance chain 396 is wrapped around a stretch roller 398. The paper sheets P that have passed the fixing drum 384 are sent to the conveyance chain 396 via the fourth transfer cylinder 394 and are transferred from the conveyance chain 396 to the paper discharge unit 392.

In the configurations of the inkjet recording apparatus 300 described above, the drying drum 376, the fixing drum 384, the intermediate conveyance section 330 between these, and so forth configure the recording medium conveyance device 400 pertaining to the second embodiment of the present invention.

Regarding the Drying Section 318

The function of the drying section 318 in the inkjet recording apparatus 300 described above will now be described.

In the second embodiment, the drying section 318 also has the function of the air blowing section 26 of the first embodiment. Specifically, the warm air nozzle 382 located at the most upstream side of the drying section 318 in the conveyance direction D1 has the same function and configuration as the air blowing unit 70 of the first embodiment.

That is, the warm air nozzle 382 is controlled by an unillustrated control unit so as to blow air in diagonal directions from a center portion of the paper sheet P toward side portions at the upstream side of the paper sheet P after the leading end of the paper sheet P is held by the holding parts 377 of the drying drum 376 and before the paper sheet P is sucked and conveyed by the drying drum 376. Further, directions in which air B1 is blown are adjusted in such a way that a width W2 of an air blowing region becomes narrower than a width W1 of the paper sheet P conveyed to the drying drum 376 before the air B1 strikes the paper sheet P.

In the second embodiment, a start-of-suction position on the drying drum 376 is set in a position where an adjacent IR heater 380 at the downstream side to the warm air nozzle 382, which is located on the most upstream side of the drying section 318 in the conveyance direction D1, is placed.

Operation

As described above, in the inkjet recording apparatus 300 and the recording medium conveyance device 400 pertaining to the second embodiment, the warm air nozzle 382 is controlled to adjust beforehand an it's angle of inclination θ1 in such a way that air can be blown in diagonal directions from the center portion of the paper sheet P toward the side portions at the upstream side (the upstream side in the conveyance direction D1) of the paper sheet P like the states of the paper sheet P shown in FIGS. 8A to 8D of the first embodiment, so when the paper sheet P passes the warm air nozzle 382, the warm air nozzle 382 blows air in the diagonal directions D3 from the center portion of the paper sheet P toward the side portions at the upstream side of the paper sheet P. Because of this, a force that causes the paper sheet P to expand in the diagonal directions D3 in accompaniment with the progression of the conveyance can be applied, and the paper sheet deformation strain T (wrinkling, curling, cockling, etc.) occurring in the center portion can be dispersed (smoothed out) to the side rear end portions of the paper sheet P or removed. Consequently, when the paper sheet P is conveyed by the drying drum 376 and the suction is started, the paper sheet deformation strain T in the paper sheet P has been dispersed or eliminated, and wrinkling of the paper sheet P at the time of the suction conveyance can be suppressed.

In the recording medium conveyance device 400 pertaining to the second embodiment of the present invention, the paper sheet P is rotated and conveyed in a state in which it is sucked and closely held on the drying drum 376, so the posture of the paper sheet P can be held.

<Modifications>

The present invention has been described in detail regarding the first and second embodiments, but the present invention is not limited to these embodiments. It will be apparent to those skilled in the art that a variety of other embodiments are possible in the scope of the present invention. For example, the several embodiments described above can be combined and implemented as appropriate. And the modifications described below may also be combined as appropriate.

For example, a case has been described where the air blowing control unit 226 controls the air blowing unit 70 to adjust the angle of inclination θ1, that is, the direction in which the air B1 is blown in accordance with the width W1 of the paper sheet P conveyed from the image recording drum 52 to the conveyance mechanism 90, but the air blowing control unit 226 may also be configured to adjust the direction in which the air B1 is blown or the air volume of the air B1, or the direction and the air volume of the air B1, in accordance with the rigidity of the paper sheet P. Note that the width W2 of the air blowing region can be adjusted by adjusting the direction in which the air B1 is blown.

Specifically, a table in which types of the paper sheets, rigidities, settings for the width W2 of the air blowing region, and air volume settings are associated with one another such as shown in Table 1 below may be recorded beforehand in the RAM or the ROM of the system controller 200, and the inkjet recording apparatus 10 may reference this table per paper sheet P onto which the air is blown.

TABLE 1

| Type of Paper Sheet | Rigidity | Width W2 of Air Blowing Region | Air Volume |
|---|---|---|---|
| Thin Paper | Low | Narrow | High in Center Portion |
| Normal Paper | Medium | Normal | Medium in Middle Portion |
| Thick Paper | High | Wide | Flat |
| OHP Film | Higher | Wider | Flat |

In a case where the paper sheet P is thin paper, the rigidity of the paper sheet P is lower than that of normal paper and the paper sheet P tends to flap, so by making an adjustment in such a way that the width W2 of the air blowing region becomes narrower than in the case of normal paper as shown in Table 1, flapping of the paper sheet P at the time of the air blowing can be suppressed even more. Further, in a case where the paper sheet P is thin paper, the rigidity of the paper sheet P is lower than that of normal paper and the amount of the paper sheet deformation strain may be larger, so by making an adjustment to increase the air volume, particularly the air volume in the center portion becomes large compared to the case of normal paper, the paper sheet deformation strain T in the paper sheet P can be dispersed even more to the side rear end portions or removed.

On the other hand, in a case where the paper sheet P is thick paper or OHP film, the rigidity of the paper sheet P is higher than that of normal paper, so it is difficult for the paper sheet P to flap and the amount of the paper sheet deformation strain is also smaller. For this reason, adjustments are made to make the width W2 of the air blowing region wider and the air volume less than in the case of normal paper.

Further, a case has been described where the air blowers 72 of the air blowing unit 70 have the nozzles 78 in the first embodiment, but the air blowers 72 may also be configured without nozzles. In such a case, it is preferred that the blowers be high static pressure blowers whose air volume is large. The air volume of the blowers can be adjusted by controlling the blower input current value.

The air blowers 72 may also be equipped with heaters that turn the air into hot air. This is because the paper sheet P onto which the liquid droplets have been jetted can be dried by the hot air from the air blowers 72, and therefore the paper sheet deformation strain T can be reduced even more. In a case where the air blowers 72 are equipped with heaters, or in a case where drying means like the ink drying treatment section 20 is disposed in the neighborhood of the air blowers 72, it is preferred that the material of the air blowers 72 be a heat-resistant material.

Further, a case has been described where the direction in which the air B1 is blown is adjusted by adjusting the angle of inclination θ1 of the nozzles 78, but blade panels (having an identical configuration and function as so-called air conditioner blade panels) may be disposed in the nozzle outlets 80 of the nozzles 78, and the direction in which the air B1 is blown from the nozzles 78 can be adjusted by making arm portions of the blade panels movable about 180°.

Further, the four nozzles 78 communicated with the air volume regulation unit 76A are designed in such a way that they all have the same angle of inclination θ1 when their angle of inclination is adjusted. Likewise, the four nozzles 78 communicated with the air volume regulation unit 76B are also designed in such a way that they all have the same angle of inclination −θ1 when their angle of inclination is adjusted, but the nozzles 78 may also be configured such that their angle of inclination θ1 can be adjusted individually.

Likewise, in the first embodiment, the angle θ2 of the nozzles 78 was configured to be unadjustable and fixed in contrast to the angle of inclination θ1, but the angle θ2 may also be given an adjustable configuration. Further, the angle θ2 may also be given an adjustable configuration among the individual nozzles 78. When the angle θ2 of the nozzles 78 positioned on the side end portions of the paper sheet P is made smaller than in the center portion of the paper sheet P and the air B1 is blown on the downstream side in the conveyance direction D1 heading to the side end portions, the effect of dispersing the paper sheet deformation strain T that tends to occur in the center portion of the paper sheet P to the side rear end portions is strengthened.

Further, the air blowing control unit 226 may also control the air volume per paper sheet region such as, for example, increasing the air volume of the nozzles 78 from the leading end portion to the trailing end portion of the paper sheet P. By minimizing air blowing regions in which the air is blown strongly, flapping of the paper sheet P can be reduced even more.

Furthermore, the air blowing control unit 226 may also perform so-called "intermittent air blowing" control in such a way that there exist regions in which the air blowing is not implemented while the paper sheet P is passing through the air blowing section 26, such as implementing the air blowing only at the time when the trailing end portion of the paper sheet P passes the air blowing section 26.

Figure 11A:
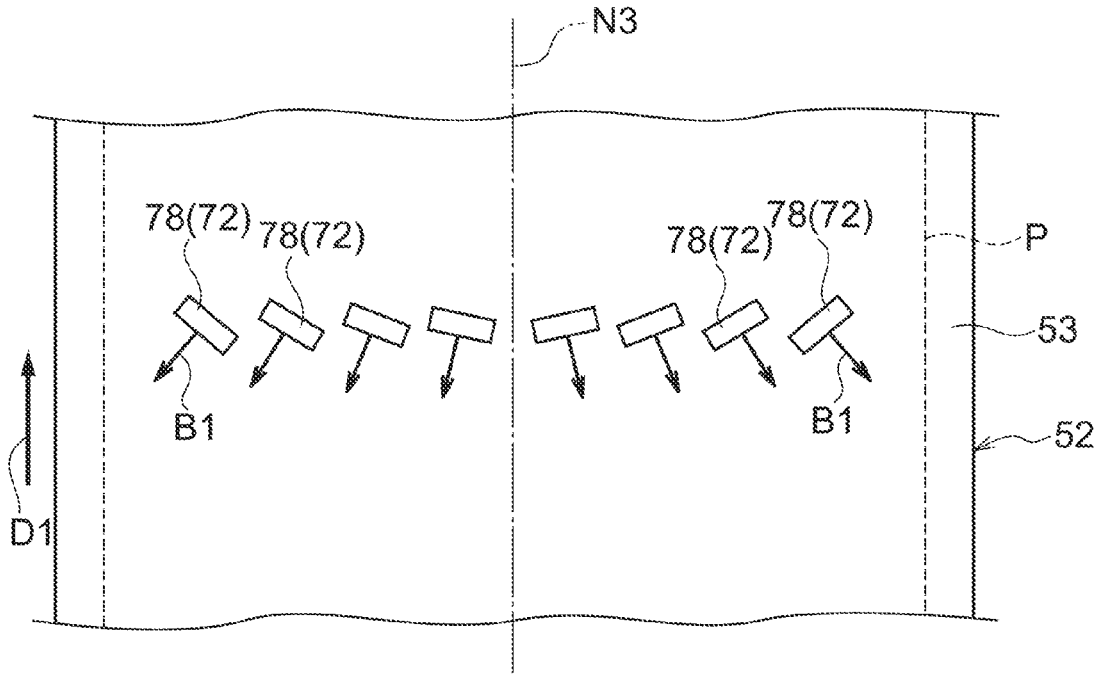
FIGS. 11A and 11B are plan views showing modifications of the state of inclination of the nozzles of the air blowing unit after control by the air blowing control unit.

Further, as shown in FIG. 11A, the air blowing control unit 226 may adjust the directions in which the air B1 is blown by the air blowers 72 in such a way that their inclination with respect to the centerline N3 of the paper sheet P becomes greater gradually from the center portion toward the side portions of the paper sheet P. This is because the paper sheet deformation strain T occurring in the center portion of the paper sheet P can be dispersed gradually to the side rear end portions of the paper sheet P or removed.

Figure 11B:
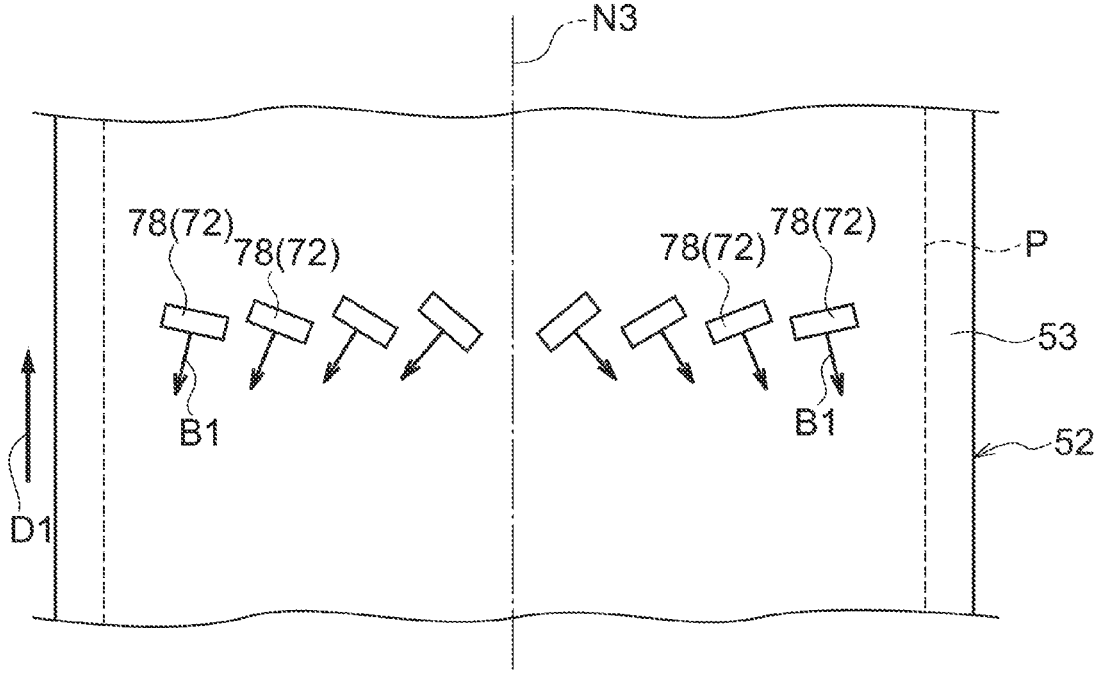

Conversely, as shown in FIG. 11B, the air blowing control unit 226 may also adjust the directions of the air B1 in such a way that their inclination with respect to the centerline N3 of the paper sheet P becomes smaller gradually from the center portion toward the side portions of the paper sheet P. This is because the paper sheet deformation strain T occurring in the center portion of the paper sheet P can be exerted with the air for a longer time such that the paper sheet deformation strain T is dispersed in the directions toward the side rear ends or removed while the air B1 at the side end portions of the paper sheet P can be prevented from going outside the paper sheet P.

Figure 12:
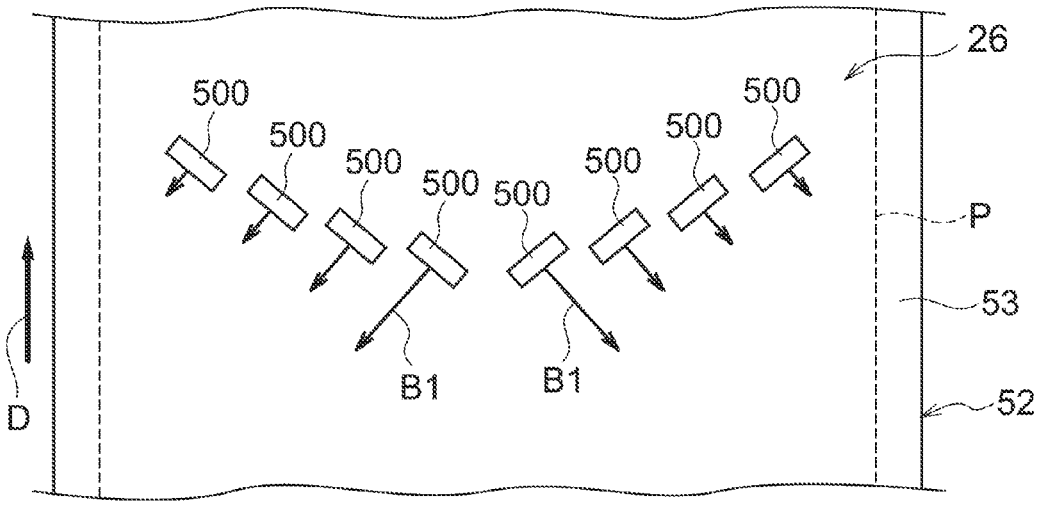
FIG. 12 is a plan view showing a modification of the state of placement of the nozzles of the air blowing unit after control by the air blowing control unit.

Further, as shown in FIG. 12, the air blowing section 26 may also be equipped with plural air blowers 500 placed along the conveyance direction D1. This is because wrinkling of the paper sheet P at the time of the suction conveyance can be suppressed even more.

In this case, the air blowing control unit 226 of the air blowing section 26 may adjust the directions in which the air B1 is blown in such a way that the width of the air blowing of the air blowers 500 disposed on the downstream side in the conveyance direction D1 becomes wider than the width of the air blowing region of the air blowers 500 disposed on the upstream side in the conveyance direction D1. In this way, when the width of the air blowing region of the air blowers 500 (overall) disposed on the upstream side in the conveyance direction D1 is narrower than the width of the air blowing region of the air blowers 500 (overall) disposed on the downstream side, at the time of the conveyance, the air first becomes blown with respect to the center portion of the paper sheet P. As a result, the paper sheet deformation strain T in the center portion of the paper sheet P is dispersed (smoothed out) to the side ends and the air becomes blown in a wider air blowing region width in accompaniment with the progression of the conveyance, the paper sheet deformation strain T that has been dispersed to the side ends can be dispersed further and made uniform in the width direction of the paper sheet P, and wrinkling of the paper sheet P at the time of the suction conveyance can be suppressed even more.

Figure 13:
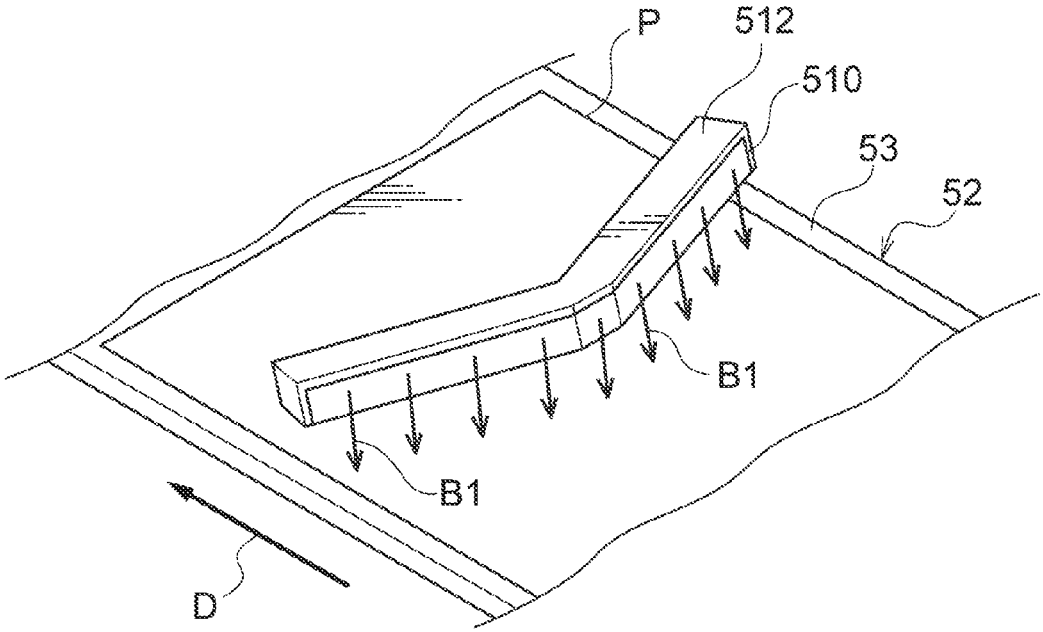
FIG. 13 is a diagram showing a modification of the air blowing unit pertaining to the first embodiment.

Further, a case has been described where the air blowing section 26 is equipped with the plural air blowers 72 that are placed along the width direction (the width direction D2) of the conveyed paper sheet P, but as shown in FIG. 13 the air blowing section 26 may also be equipped with an air blower 512 that has one air outlet 510 extending long from the center portion toward the side end portions in the downstream side of the paper sheet P. Because of this, the air B1 can be applied uniformly from the center portion to the side end portions at the downstream side of the paper sheet P so that, for example, wrinkles can be prevented from concentrating locally.

Further, a case has been described where the air blowing section 26 is configured by the air blowing unit 70 and the image recording drum 52, the blowing unit 70 is disposed between the inkjet heads 56C, 56M, 56Y, and 56K and the chain gripper 64 in the conveyance direction D1, but the location and the configuration of the air blowing section 26 are not particularly limited.

For example, the air blowing section 26 may also be disposed on the upstream side, in the conveyance direction D1, of the inkjet heads 56C, 56M, 56Y, and 56K. Alternately, the air blowing section 26 may also be disposed between the paper sheet pressing roller 54 and the inkjet heads 56C, 56M, 56Y, and 56K along the conveyance direction D1.

Figure 14:
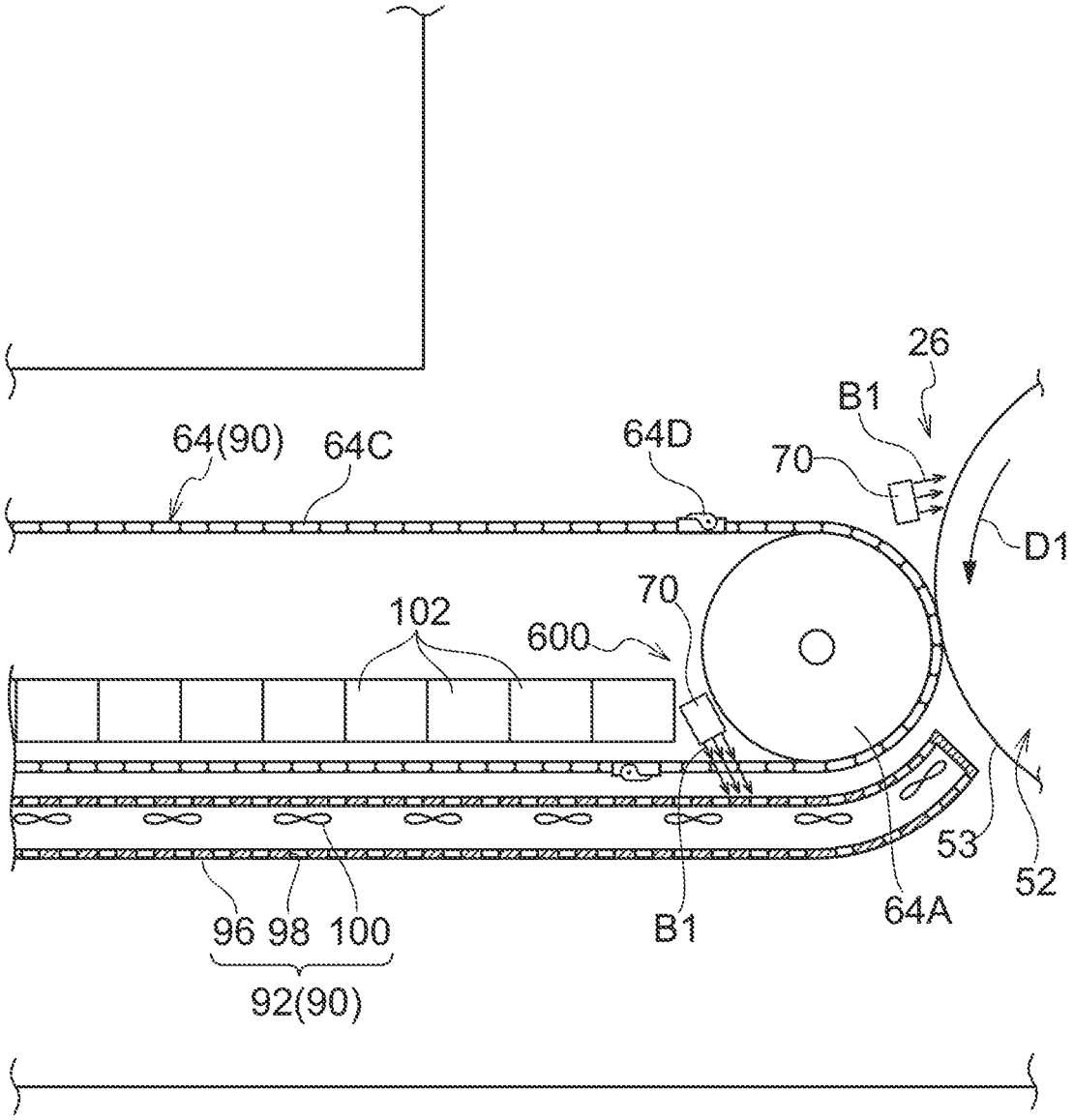
FIG. 14 is a diagram showing a modification of the placement of the air blowing section.

Furthermore, as shown in FIG. 14, an air blowing section 600 that is configured by part of the conveyance mechanism 90 and the air blowing unit 70 may additionally be disposed in the inkjet recording apparatus 10 separately from the air blowing section 26 or alone. The air blowing section 600 is disposed between the first sprocket 64A and the ink drying treatment units 102 in the conveyance direction D1. In this case, relationship between the suction and the air blowing is set such that the start-of-suction position in the conveyance mechanism 90 is disposed at the downstream side of the air blowing section 600 in the conveyance direction D1. Further, even if the suction were to be started at the time of the air blowing, it is believed that an air blowing effect can be obtained if a region of blowing to the paper sheet P in the air blowing section 600 is narrower than a region of restraint resulting from the suction device at the downstream side in the conveyance direction D1.

Figure 15:
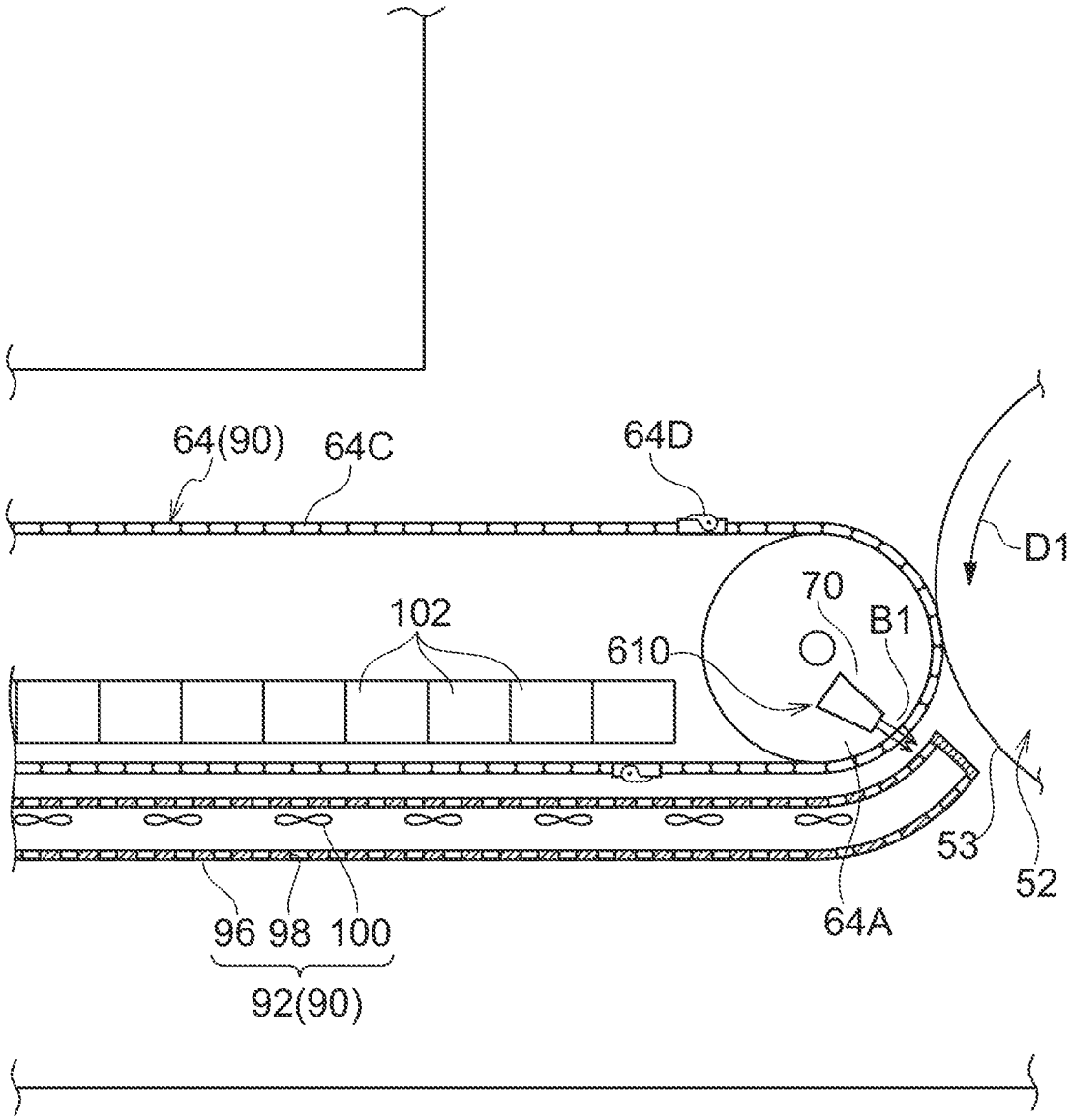
FIG. 15 is a diagram showing another modification of the placement of the air blowing section.

Further, as shown in FIG. 15, an air blowing section 610 configured by part of the conveyance mechanism 90 and the air blowing unit 70 may also be disposed in the inkjet recording apparatus 10 separately from the air blowing section 26 or alone. The air blowing unit 70 is disposed in a space around a central shaft of the first sprocket 64A Here, reference will be made to the relationship between a region of restraint of the paper sheet P at the time of the air blowing in the air blowing section 26 and a region of restraint of the paper sheet P at the time of the suction conveyance in the conveyance mechanism 90 in the first embodiment.

Assuming that a conveying part (the image recording drum 52) of the paper sheet P at the time of the air blowing by the air blowing section 26 is second conveying part and that the conveying parts (the conveyance mechanism 90) at the time of the suction conveyance is first conveying part, an air blowing effect is effectively obtained if the region of restraint of the paper sheet P by the second conveying part at the time of the air blowing is narrower than the region of restraint of the paper sheet P by the first conveying part at the time of the suction conveyance. Specifically, an air blowing unit is disposed in an upper portion of the second conveying part, and the air blowing unit blows air in diagonal directions from the center portion of the recording medium conveyed by the second conveying part toward the side portions at the upstream side of the recording medium and adjusts the direction in which the air is blown in such a way that the width of the air blowing region becomes narrower than the width of the recording medium conveyed by the second conveying part before the air strikes the recording medium.

Figure 16A:
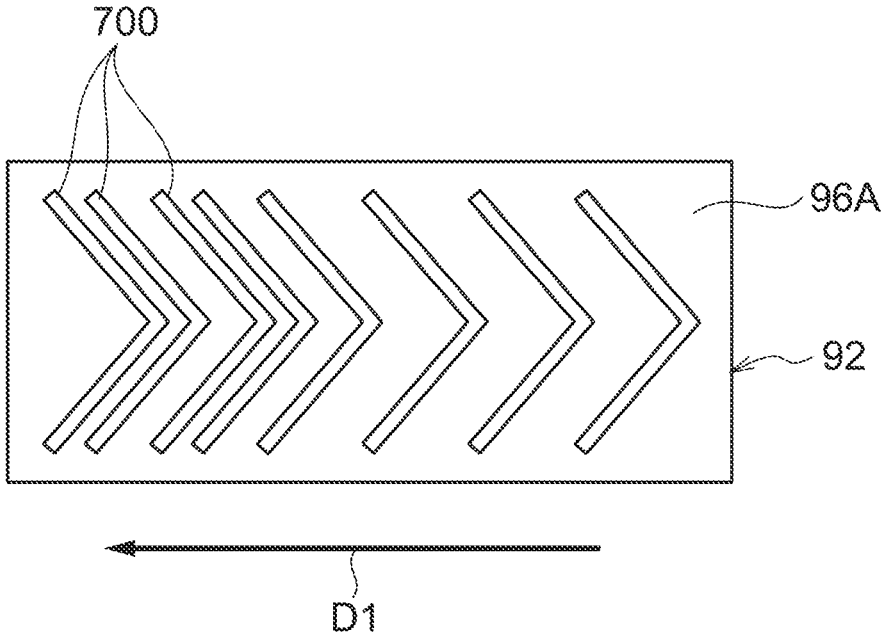
FIGS. 16A and 16B are diagrams showing modifications of openings disposed in a sliding contact surface of the guide plate pertaining to the first embodiment.

Further, a case has been described where the openings disposed in the sliding contact surface 96A are the circular holes 98, but the openings disposed in the sliding contact surface 96A may also be V-shaped holes 700 such as shown in FIG. 16A.

The suction V-shaped holes 700 shown in FIG. 16A are not simply changed shapes but top portions of the V shapes are positioned at downstream sides in the conveyance direction D1 of the paper sheet P, and the V-shaped openings are plurally arranged along the conveyance direction D1. Because of this, a force that causes the paper sheet P to expand in diagonal directions from the center portion toward the side rear ends of the paper sheet P can be applied in accompaniment with the progression of the conveyance on the sliding contact surface 96A. The paper sheet deformation strain T that tends to occur in the center portion of the paper sheet P can be dispersed to the side rear end portions or removed.

Figure 16B:
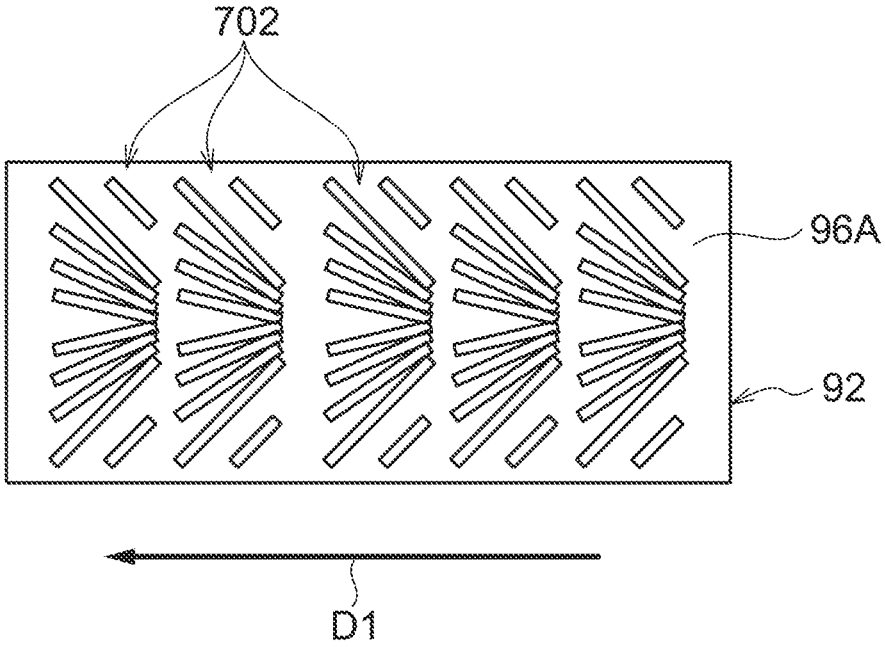

Likewise, the openings disposed in the sliding contact surface 96A may also be suction holes 702 such as shown in FIG. 16B. Rectangle suction holes 702 shown in FIG. 16B are, like the suction V-shaped holes 700 in FIG. 16A, provided to form proximately fan-shaped openings whose downstream sides in the conveyance direction D1 of the paper sheet P become top portions of fan shapes, and the fan-shaped openings are plurally placed in the sliding contact surface 96A.

Further, conversely from what has been described above, the suction holes disposed in the sliding contact surface 96A may also be inverted V-shaped openings whose downstream sides in the conveyance direction D1 of the paper sheet P become bottom portions of the V shapes. According to this configuration, in a case where the air is additionally blown during the suction conveyance, flapping at the time of the suction conveyance of the recording medium caused by the air traveling around from the back surface of the recording medium can be effectively deterred.

Further, the recording medium conveyance device may also be equipped with drying means (e.g., a heater) that applies heat directly to the sliding contact surface 96A to thereby dry the paper sheet P. By configuring the recording medium conveyance device in this manner, the paper sheet P can be dried from the back surface, so it is difficult for the liquid droplets to bleed even when drying is performed.

Further, the suction fans 100 that suck in air from the suction holes 98 in the sliding contact surface 96A may also be plurally disposed in the width direction of the sliding contact surface 96A, and the suction force of the suction fans 100 in the width direction of the sliding contact surface 96A may be controlled in accordance with the image data to be printed. By giving the recording medium conveyance device this kind of configuration, for example, in a case where it has been judged on the basis of the image data that the liquid droplet jetting quantity will be greater in a certain place in the width direction of the paper sheet P than in other places, the suction volume in that place can be increased compared to the other places in the width direction.

Further, a case has been described where the drum cooling unit 62 blows cold air onto the image recording drum 52 to thereby cool the image recording drum 52, but the drum cooling unit 62 may be omitted and the air blowing section 26 may be configured to cool the image recording drum 52. In this case, the temperature of the air B1 blown by the air blowing section 26 is decided by its relationship with the temperature of the inkjet heads 56C, 56M, 56Y, and 56M (particularly the temperature of the nozzle surfaces) and is configured to become a lower temperature than the temperature of the inkjet heads 56C, 56M, 56Y, and 56K.

Figure 17:
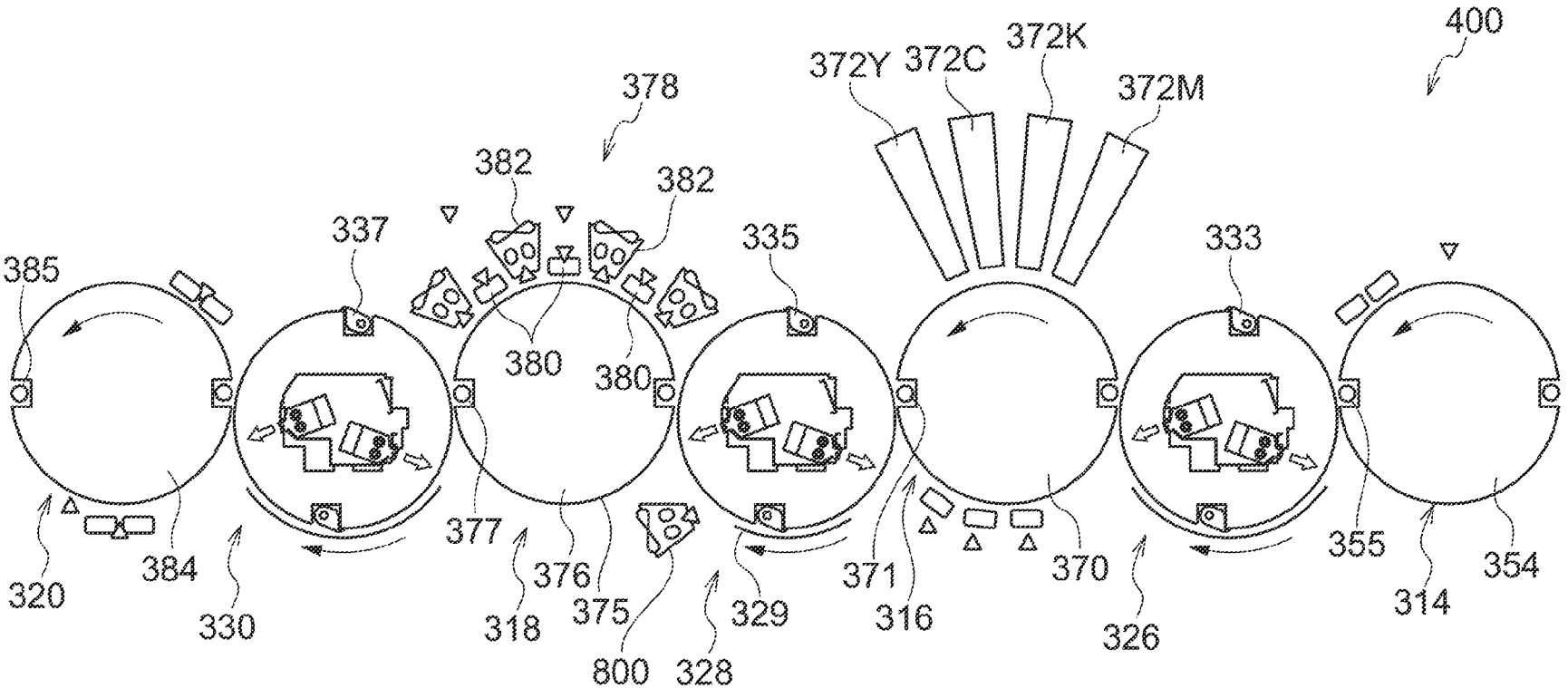
FIG. 17 is a diagram showing a modification of the image forming apparatus pertaining to the second embodiment.

Further, in the second embodiment, a case has been described where the warm air nozzle 382 located on the most upstream side of the drying section 318 in the conveyance direction D1 had the same function and configuration as those of the air blowing unit 70 of the first embodiment, but a nozzle having the same function and configuration as those of the air blowing unit 70 may also be disposed separately from the warm air nozzles 382. For example, as shown in FIG. 17, a warm air nozzle 800 having the same function and configuration as those of the air blowing unit 70 may be disposed on the conveyance direction D1 downstream side of the second transfer cylinder that is the intermediate conveyance section 328. When disposing the warm air nozzle 800, if a conveyance guide 329 located below the second transfer cylinder is a hindrance, the length of the conveyance guide 329 may be shortened.

Figure 18:
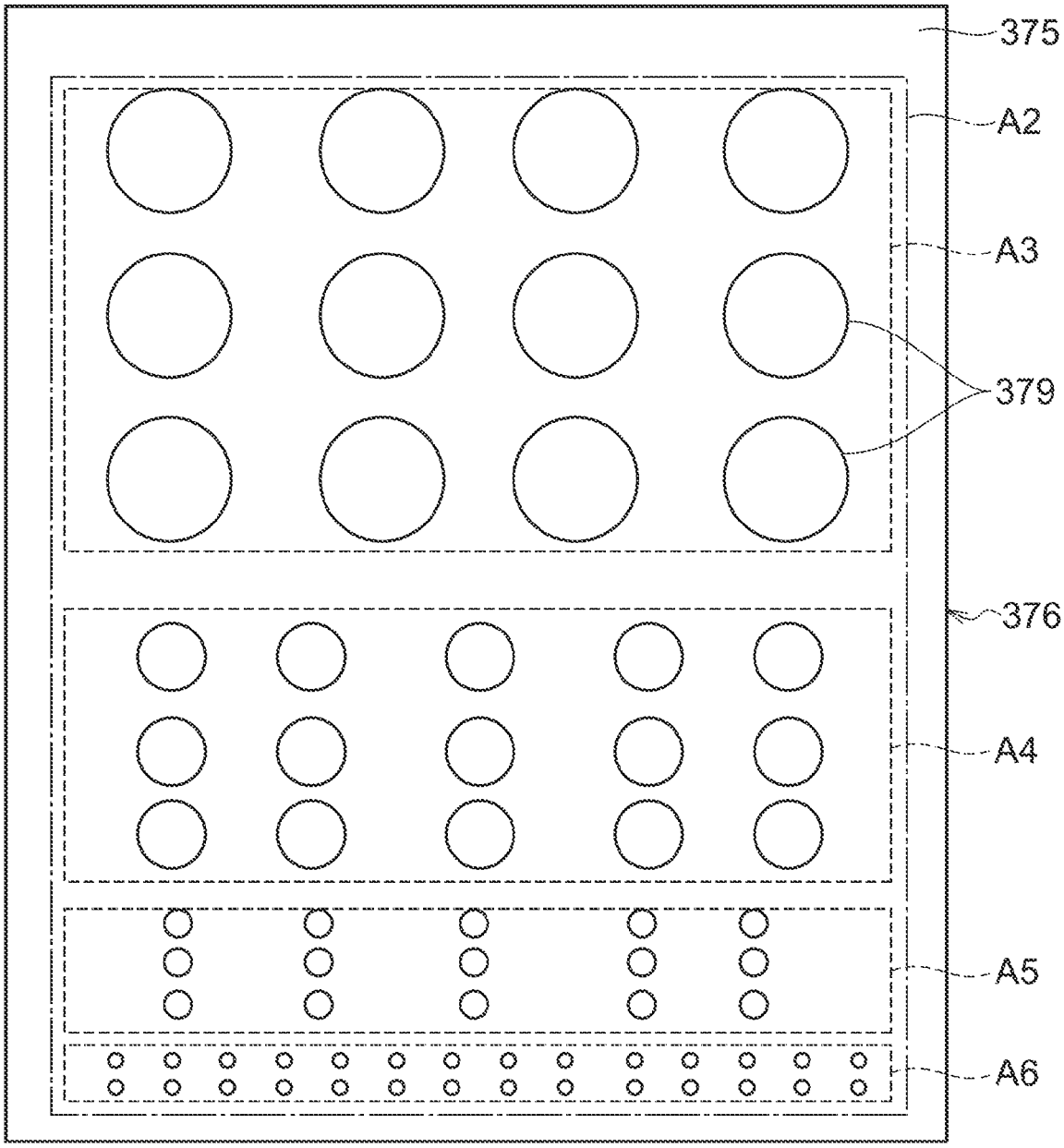
FIG. 18 is a diagram showing an example of openings disposed in a sliding contact surface of a drying drum pertaining to the second embodiment.

In the case of disposing the warm air nozzle 800, as shown in FIG. 18, a suction region A2 of the outer peripheral surface 375 of the drying drum 376 may be segmented from a place (region A3) that sucks the leading end portion of the paper sheet P toward a place (region A6) that sucks the trailing end portion of the paper sheet P.

That is, the suction region A2 is divided into plural subregions A3 to A6 and the intervals between the suction subregions is shortened from the downstream side toward the upstream side in the conveyance direction D1.

Further, opening areas of suction holes 379 located in the suction region A2 of the outer peripheral surface 375 is set in such a way as to increase in a stepwise manner from the upstream side toward the downstream side in the conveyance direction D1.

In the case of the configuration shown in FIG. 18, suction is started at the point in time when the leading end of the paper sheet P, in which the paper sheet deformation strain T has been dispersed to the side rear end portions or removed by the warm air nozzle 800, is held by the holding parts 377 of the drying drum 376.

Figure 19A:
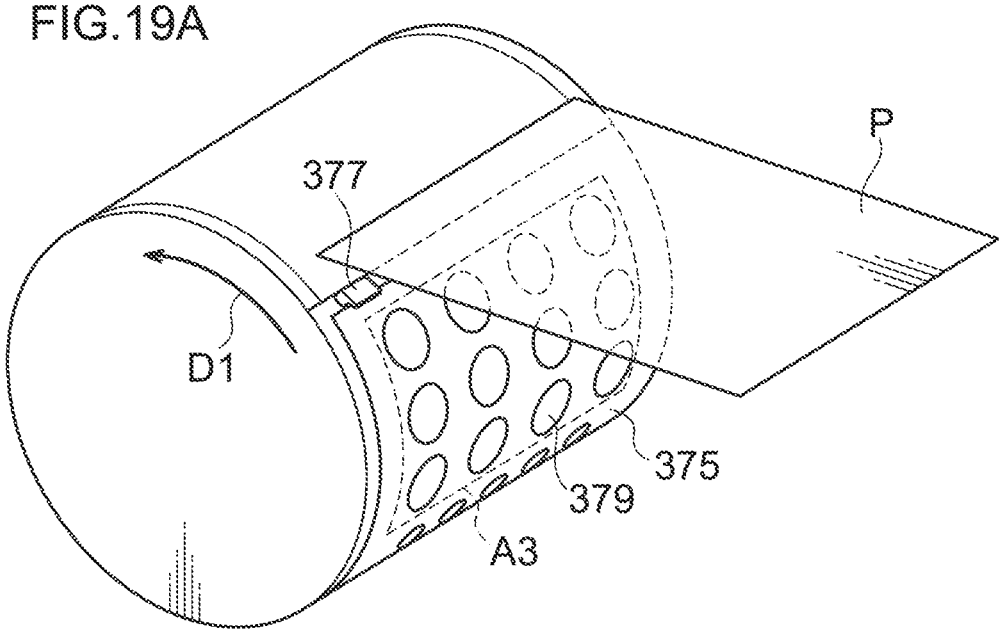
FIGS. 19A to 19C are diagrams sequentially showing the suction of a paper sheet being started by the drying drum.
Figure 19B:
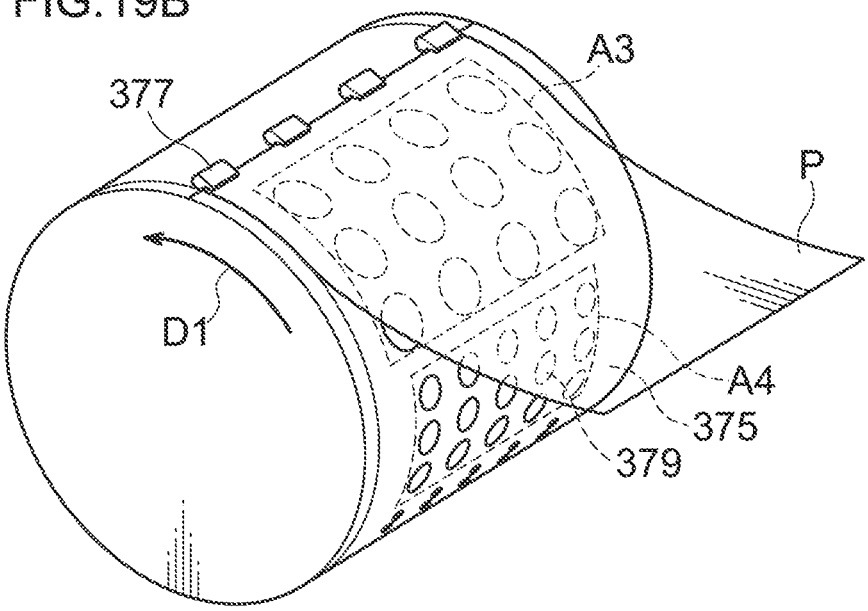
Figure 19C:
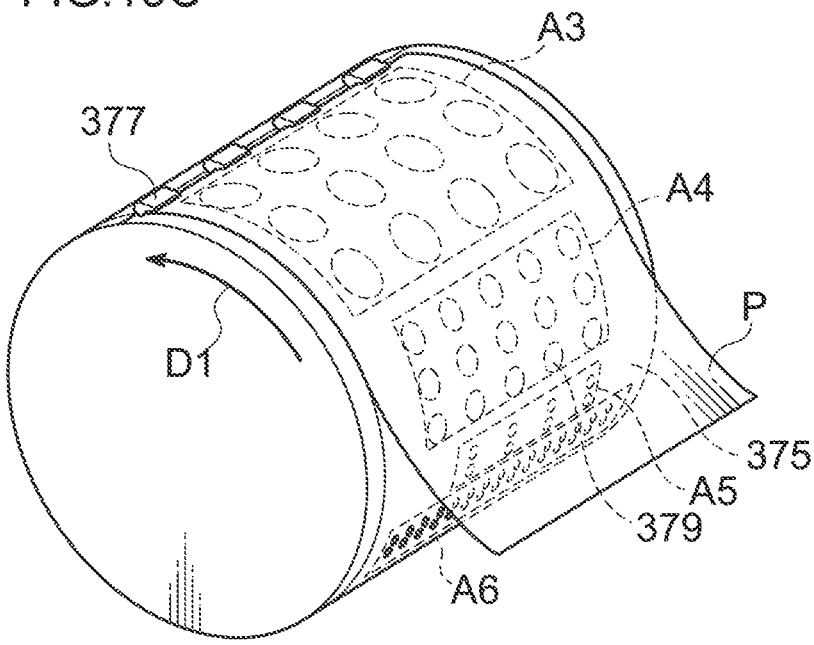

FIGS. 19A to 19C are diagrams sequentially showing the suction of the paper sheet P being started by the drying drum 376.

As shown in FIGS. 19A to 19C, when the paper sheet P is transferred to the drying drum 376, the leading end of the paper sheet P is held by the holding parts 377. When the drying drum 376 rotates toward the conveyance direction D1, first, suction is implemented from the suction region A3 of the outer peripheral surface 375 such that the leading end portion of the paper sheet P is sucked. When the drying drum 376 further rotates toward the conveyance direction D1, suction is implemented from the suction regions A3 and A4 of the outer peripheral surface 375 such that the leading end portion and the center portion of the paper sheet P are sucked. When the drying drum 376 further rotates toward the conveyance direction D1, suction is implemented from the suction regions A3 to A6 of the outer peripheral surface 375 such that the entire paper sheet P, from its leading end portion to its trailing end portion, is sucked. Consequently, suction can be started in a stepwise manner from the leading end portion to the trailing end portion of the paper sheet P.

Further, in the first embodiment, the process liquid application section 14 is given a configuration where the process liquid is applied by means of a roller, but the method of applying the process liquid is not limited to this. In addition to this, a configuration that uses an inkjet head to apply the process liquid or a configuration that applies the process liquid by spraying it can also be employed.

Further, the mechanism that causes the paper sheet P to be sucked and held on the peripheral surface of the image recording drum 52 is not limited to a suction method resulting from negative pressure like in the first embodiment and can also employ a method resulting from electrostatic attraction.

Further, in the above embodiments, the inkjet recording apparatus has been given as an example of the image forming apparatus, but the liquid that is jetted is not limited to ink for recording images and printing characters. As long as the liquid is a liquid that uses a solvent or a dispersion medium that seeps into the recording medium, it can be applied to a variety of jetted liquid (liquid droplets).

Examples

Working examples will be described below, but the present invention is in no way limited by these working examples.

In the working examples, the relationship between the width W2 of the air blowing region of the air blowing unit 70 and the width W1 of the paper sheet P onto which the air is blown was investigated.

Specifically, a half-Kiku size (636 mm×469 mm) paper sheet P whose width W1 is 636 mm was used, and in this case, the result of pressing the paper sheet P and how flapping of the paper sheet P changes when the width W2 of the air blowing region is changed with respect to the width W1 of the paper sheet P was investigated. This investigation was performed with the configuration of the inkjet recording apparatus of the first embodiment.

Table 2 summarizes the results of investigating the pressing effect and how flapping of the paper sheet P changes when the width W2 of the air blowing region is changed with respect to the width W1 of the paper sheet P. In relation to the pressing effect in the table, "H" means that the pressing effect is high and "L" means that the pressing effect is low. Further, in relation to flapping in the table, "H" means that there was substantially no flapping, "L" means that flapping occurred 3 times or fewer in tests of 10 times, and "X" means that flapping occurred 9 times or more in tests of 10 times.

TABLE 2

| (W2/W1) × 100 (%) | Pressing Effect | Flapping |
|---|---|---|
| 30 | L | H |
| 45 | L | H |
| 49 | L | H |
| 50 | H | H |
| 75 | H | H |
| 90 | H | H |
| 91 | H | L |
| 95 | H | L |
| 100 | H | X |
| 110 | H | X |

From Table 2, it was found that the effect of pressing the side end portions of the paper sheet P can be raised if the width W2 of the air blowing region is equal to or greater than 50% of the width W1 of the paper sheet P. It was also found that flapping of the paper sheet P can be suppressed even more if the width W2 of the air blowing region is equal to or less than 95% of the width W1 of the paper sheet P. Consequently, it was concluded that adjusting the direction in which the air B1 is blown in such a way that the width W2 of the air blowing region becomes equal to 50% to 95% of the width W1 of the paper sheet P is preferred.

What is claimed is:

1. A recording medium conveyance device comprising:

a conveying unit that conveys a recording medium while sucking the recording medium onto a conveyance surface; and an air blowing unit that is disposed at an upstream side of the conveying unit in a conveyance direction of the recording medium, the air blowing unit being configured to blow air in diagonal directions from a width direction center portion toward side portions at an upstream side of the recording medium, and that adjusts a direction in which the air is blown in such a way that a width of an air blowing region of the air becomes narrower than a width of the recording medium conveyed to the conveying unit before the air strikes the recording medium, wherein the air blowing unit is disposed so as to face the upstream direction with respect to the recording medium.

2. The recording medium conveyance device according to claim 1, wherein the conveying unit is equipped with:

a gripping part that grips and conveys a leading end of the recording medium and;

a suction body that sucks, onto the conveyance surface, the recording medium conveyed by the gripping part.

3. The recording medium conveyance device according to claim 1, wherein the air blowing unit increases an air volume in a center portion in the width of the air blowing region.

4. The recording medium conveyance device according to claim 1, wherein the air blowing unit adjusts the direction in which the air is blown or adjusts the air volume in accordance with rigidity of the recording medium.

5. The recording medium conveyance device according to claim 1, wherein the air blowing unit adjusts the direction in which the air is blown in such a way that the width of the air blowing region becomes equal to from 50% to 95% of the width of the recording medium conveyed to the conveying unit.

6. The recording medium conveyance device according to claim 1, wherein the conveying unit comprises an impression cylinder that rotates in a state in which the cylinder closely holds the recording medium by sucking the recording medium onto the conveyance surface and conveys the recording medium.

7. The recording medium conveyance device according to claim 6, wherein a suction region of the conveyance surface of the impression cylinder is segmented from a place that sucks a leading end portion of the recording medium toward a place that sucks a trailing end portion of the recording medium.

8. The recording medium conveyance device according to claim 1, wherein openings for suction are formed in the conveyance surface, and an area of the openings is increased in a stepwise manner from an upstream side toward a downstream side in the conveyance direction of the recording medium.

9. The recording medium conveyance device according to claim 8, wherein the area of the openings is increased in a stepwise manner from a center portion toward side end portions in a width direction of the conveyance surface.

10. The recording medium conveyance device according to claim 8, wherein the openings are configured as V-shaped openings, top portions of the V-shaped openings are formed at downstream sides in the conveyance direction of the recording medium.

11. The recording medium conveyance device according to claim 1, wherein openings for suction are formed in the conveyance surface, and the openings are configured as inverted V-shaped openings, bottom portions of V shapes are formed at downstream sides in the conveyance direction of the recording medium.

12. The recording medium conveyance device according to claim 1, wherein the air blowing unit is equipped with plural air blowers placed along the width direction of the recording medium that is conveyed.

13. The recording medium conveyance device according to claim 12, wherein the air blowing unit adjusts the directions in which the air is blown by the air blowers in such a way that inclination of the air blowers with respect to a centerline of the recording medium becomes smaller gradually from the center portion toward the side portions of the recording medium.

14. The recording medium conveyance device according to claim 12, wherein the air blowing unit adjusts the directions in which the air is blown by the air blowers in such a way that inclination of the air blowers with respect to a centerline of the recording medium becomes larger gradually from the center portion toward the side portions of the recording medium.

15. The recording medium conveyance device according to claim 1, wherein the air blowing unit is equipped with plural air blowers placed along the conveyance direction of the recording medium.

16. The recording medium conveyance device according to claim 15, wherein the air blowing unit adjusts the direction in which the air is blown in such a way that a width of an air blowing region of the air blower disposed on the downstream side in the conveyance direction becomes wider than a width of an air blowing region of the air blower disposed on the upstream side in the conveyance direction.

17. The recording medium conveyance device according to claim 1, wherein the air blowing unit is equipped with a heater that turns the air into hot air.

18. The recording medium conveyance device according to claim 1, further comprising drying unit that dries the recording medium conveyed by the conveying unit.

19. The recording medium conveyance device according to claim 18, wherein the drying unit applies heat to the conveyance surface to thereby dry the recording medium.

20. An image forming apparatus comprising:

the recording medium conveyance device according to claim 1; and a liquid droplet jetting head that jets liquid droplets onto the recording medium to draw an image, wherein the air blowing unit is disposed between the liquid droplet jetting head and the conveying unit.

21. The image forming apparatus according to claim 20, wherein the air blowing unit increases a volume of the air with respect to a drawn section of the recording medium where the liquid droplets have been jetted to be greater than a volume of the air with respect to a non-drawn section.

* * * * *